US006970570B2

(12) United States Patent
Goldstein

(10) Patent No.: US 6,970,570 B2
(45) Date of Patent: Nov. 29, 2005

(54) HEARING AIDS BASED ON MODELS OF COCHLEAR COMPRESSION USING ADAPTIVE COMPRESSION THRESHOLDS

(75) Inventor: Julius L. Goldstein, St. Louis, MO (US)

(73) Assignee: Hearing Emulations, LLC, St. Louis, MO (US)

( * ) Notice: Subject to any disclaimer, the term of this patent is extended or adjusted under 35 U.S.C. 154(b) by 375 days.

(21) Appl. No.: 09/935,510

(22) Filed: Aug. 23, 2001

(65) Prior Publication Data

US 2002/0057808 A1 May 16, 2002

Related U.S. Application Data

(63) Continuation-in-part of application No. 09/158,411, filed on Sep. 22, 1998.

(51) Int. Cl.[7] ..... H04R 25/00
(52) U.S. Cl. ..... 381/321; 381/106; 381/312
(58) Field of Search ..... 381/106, 321, 381/312, 104, 107, 320

(56) References Cited

U.S. PATENT DOCUMENTS

| | | | | |
|---|---|---|---|---|
| 3,518,578 A | | 6/1970 | Oppenheim et al. | |
| 3,920,931 A | * | 11/1975 | Yanick, Jr. | |
| 3,989,904 A | | 11/1976 | Rohrer et al. | |
| 4,536,844 A | | 8/1985 | Lyon | |
| 4,701,953 A | * | 10/1987 | White | 704/226 |
| 4,887,299 A | * | 12/1989 | Cummins et al. | |
| 5,357,251 A | | 10/1994 | Morley, Jr. et al. | |
| 5,402,493 A | | 3/1995 | Goldstein | |
| 5,488,668 A | * | 1/1996 | Waldhauer | 381/320 |
| 5,832,097 A | * | 11/1998 | Armstrong et al. | 381/321 |
| 5,838,807 A | * | 11/1998 | Andersson et al. | 381/321 |
| 5,903,655 A | | 5/1999 | Salmi et al. | |
| 5,923,767 A | * | 7/1999 | Frindle et al. | 381/106 |

FOREIGN PATENT DOCUMENTS

| | | |
|---|---|---|
| FR | 2610162 | 7/1998 |
| GB | 2310983 | 9/1997 |
| WO | WO9818294 | 5/1999 |

OTHER PUBLICATIONS

Watson, N.A., and Knudsen, V.O., Selective amplification in hearing aids. J. Acoust. Soc. Am.11, 406–419 (1940).
Blachman, Nelson M.; "Band–Pass Nonlinearities"; IEEE Transactions on Information Theory; IT–10; 1964; pp. 162–164.

(Continued)

*Primary Examiner*—Brian T. Pendleton
(74) *Attorney, Agent, or Firm*—Thompson Coburn LLP

(57) ABSTRACT

A hearing aid device providing instantaneous gain compression for sound signals and adaptive control of nonlinear waveform distortion, the device comprising: (a) at least one bandpass nonlinearity (BPNL) amplifier comprising a first bandpass filter, a second bandpass filter, and a memoryless nonlinear (MNL) compressive audio amplifier configured to receive a sound signal from the first bandpass filter and provide an MNL compressive audio amplifier output to the second bandpass filter, wherein the MNL compressive audio amplifier is configured to produce the MNL compressive audio amplifier output by providing memoryless gain compression directly on a sound signal that is (1) received from the first bandpass filter and (2) exhibits instantaneous amplitudes greater than a compression threshold, the BPNL amplifier thereby producing a desired gain compression on the received sound signal at an output of the second bandpass filter, and (b) a controller in communication with the BPNL amplifier, the controller being configured to adjust the compression threshold of the MNL compressive audio amplifier. Adjustment of the compression threshold in each BPNL amplifier may be achieved at least partially in response to a user input and/or to sound signal changes. By adaptively controlling the compression threshold, performance of the device can by optimized to match its environment.

71 Claims, 10 Drawing Sheets

OTHER PUBLICATIONS

Goldstein, Julius L., Modeling rapid waveform compression on the basilar membrane as multiple–band–pass–nonlinearity filtering, Hearing Research, 49 (1990) pp. 39–60.

Goldstein, Julius L., Changing Roles in the Cochlear Bandpass Filtering by the Organ of Corti and Additive Amplification on the BaSilian Membrane, ASA Meeting, New Orleans, LA, Paper 4aPP3, Nov. 3, 1992, pp. 1–14.

Ghitza, Oded, Adequacy of auditory models to predict human internal representation of speech sounds, pp. 2160–2171. (1993). J. Acoust. Soc. Am.

Brundin, Lou et al., Sound Induced Movements and Frequency Tuning in Outer Hair Cells Isolated From the Guinea Pig Cochlea, PREPRINTS, Symposium: Biophysics of Hair Cell Sensory Systems, Duifhuis, et al., Editors, pp. 121–127.

J. Santos–Sacchi, On the Frequency Limit and Phase of Outer Hair Cell Motility: Effects of the Membrane Filter, The Journal of Neuroscience, May 1992, 12(5): pp. 1906–1916.

Jont B. Allen and Stephen T. Neely, Micromechanical Models of The Cochlea, Physics Today, Jul., 1992, pp. 40–47.

Dillon, Tutorial Compression? Yes, But for Low or High Frequencies, for Low or High Intentisities, and with What Response Times?, *Ear & Hearing,* 17:287–307 (1996).

Dillon, Compression, Noise, and Audibility: A Reply to Villchur, *Ear & Hearing,* 18(2):172–173 (1997).

Engebretson, Benefits of Digital Hearing Aids, *IEEE Engineering in Medicine and Biology,* pp. 238–248 (Apr./May 1994).

Goldstein, Exploring new principles of cochlear operation: bandpass filtering by the organ of Corti and additive amplification by the basilar membrane, *Proceedings of the International Symposium on Biophysics of Hair Cell Sensory Systems,* pp. 315–322 (Jun. 28–Jul. 3, 1993).

Goldstein, Cochlear Signal Processing for Compression and Gain Control Extends Dynamic Range and Preserves Temporal Modulation, *NIDCD/VA Hearing Aid Research and Development Conference,* Sep. 22–24, 1997.

Goldstein, Relations among compression, suppression, and combination tones in mechanical responses of the basilar membrane: data and MBPNL model, *Hearing Research* 89:52–68 (1995).

Killion, M., and Fikret–Pasa, S., The 3 Types of Sensorineural Hearing Loss: Loudness and Intelligibility Considerations, *The Hearing Journal* 46(11):31–34 (1993).

Lin, T., and Goldstein, J.L., Implementation of the MBPNL Nonlinear Cochlear I/O Model in the C Programming Language, and Applications for Modeling Impaired Auditory Function, *ModelingSensorineural Hearing Loss*, Chapter 4, pp. 67–78 (1997).

Plomp, Noise, Amplificaiton, and Compression: Considerations of Three Main Issues in Hearing Aid Design, *Ear & Hearing* 15(1):2–12 (1994).

Villchur, Comments on "Compression? Yes, But for Low or High Frequencies, for Low or High Intensities, and with What Response Times?", *Ear & Hearing,* 18(2),:169–171 (1997).

Abbas, P.J. and Sachs, M.B., Two–tone suppression in auditory–nerve fibers: Extension of stimulus response relationship. J. Acoust. Soc. Am. 59, 112–122 (1976).

Allen, J.B., Hall, J.L., and Jeng, P.S., Loudness growth in ½–octave bands (LGOB)—A procedure for the assessment of loudness. J. Acoust. Soc. Am. 88, 745–753 (1990).

Bilger, R.C., Nuetzel, J.M., Rabinowitz, W.M., and Rzeckowski, C., Standardization of a test of speech perception in noise. J. Speech Hear. Res. 27, 32–48 (1984).

Deng, L. and Geisler, C.D., Responses of auditory–nerve fibers to nasal consonant–vowel syllables. J. Acoust. Soc. Am. 82, 1977–1988 (1987).

Duifhuis, H., Cochlear nonlinearity and second filter: Possible mechanism and implications. J. Acoust. Soc. Am. 59, 408–423 (1976).

Duifhuis, H., Level effects in psychophysical two–tone suppression. J. Acoust. Soc. Am. 67, 914–927 (1980).

Engebretson, A.M., Morley, R.E., and Popelka, G.R., Development of an ear–level digital hearing aid and computer assisted fitting procedure. J. Rehab. Res. Devel., 24 (4), 55–64 (1987).

Gifford, M.L., and Guinan, J.J., Effects of crossed–olivocochlear–bundle stimulation on cat auditory nerve fiber responses to tones. J. Acoust. Soc. Am. 74, 115–123 (1983).

Goldstein, J.L., Hearing Aids Based on Models of Cochlear Compression. NIDCD SBIR Phase II Grant Application: Phase–I Grant No. 1R43 DC04028, filed with U.S. Department of Health & Human Services Public Health Service (Unpublished).

Goldstein, J.L., Valente, M., Chamberlain, R., Gilchrist, P., and Ivanovich, D., Pilot expreiments with a simulated hearing aid based on models of cochlear compression. IHCON 2000, Lake Tahoe, CA (Aug. 24, 2000).

Goldstein, J.L., Valente, M., Chamberlain, R., Acoustic and psychoacoustic benefits of adaptive compression thresholds in hearing aid amplifiers that mimic cochlear function. J. Acoust. Soc. Am. vol. 109, p. 2355 (2001).

Kalikow, D.N., Stevens, K.N., and Elliot, L.L., Development of a test of speech intelligibility in noise using sentence materials with controlled word predictability. J. Acoust. Soc. Am. 61, 1337–1351 (1977).

Kiang, N.Y.S. and Moxon, E.C., Tails of tuning curves of auditory–nerve fibers. J. Acoust. Soc. Am. 55, 620–630 (1974).

Kiang, N.Y.S., Liberman, M.C., Sewell, W.F., and Guinan, J.J., Single unit clues to cochlear mechanisms. Hear. Res. 22, 171–182 (1986).

Levitt, H., Pickett, J.M., and Houde, R.A., Sensory Aids for the Hearing Impaired. IEEE Press, NY. (1980).

Lin, T., Quantitative Modeling of Nonlinear Auditory–Nerve Responses as Two–Factor Interactions. Abstract and Table of Contents for D.Sc. Dissertation supervised by J.L. Goldstein, Sever Inst. of Technology, Washington Univ., St. Louis, MO.

Lin, T., and Guinan, Jr., John J., Auditory nerve–fiber responses to high–level clicks: Interference patterns indicate that excitation is due to the combination of multiple drives. J. Acoust. Soc. Am. 107 (5), Pt. 1, pp. 2615–2630 (May 2000).

Lippmann, R.P., Braida, L.D., and Durlach, N.I., Study of multichannel amplitude compression and linear amplification for persons with sensorineural hearing loss. J. Acoust. Soc. Am. 69 (2), 524–534 (1981).

Mountain, D.C., Changes in endolymphatic potential and crossed olivocochlear stimulation alter cochlear mechanics. Science 210, 71–72 (1980).

Mueller, G., Hawkins, D.B., and Northern, J.L., Probe Microphone Measurements: Hearing Aid Selection and Assessment, Chapter 12: Corrections and Transformations Relevant to Hearing Aid Selection. Singular Publishing, San Diego, CA, pp. 251–268 (1992).

Murugasu, E., and Russell, I.J., The effect of efferent stimulation on basilar membrane displacement in the basal turn of the guinea pig cochlea. J. Neurosci. 16 (1), 325–332 (1996).

Neuman, A., Bakke, M.A., Mackersie, C., Hellman, S., and Levitt, H., The effect of compression ratio and release time on the categorical rating of sound quality. J. Acoust. Soc. A. 103 (5), 2273–2281 (1998).

Pfeiffer, R.R., A model for two–tone inhibition of single cochlear nerve fibers. J. Acoust. Soc. Am. 48, No. 6 (Part 2), 1373–1378 (1970).

Plack, C.J., and Oxenham, A.J., Basilar membrane nonlinearity estimated by pulsation threshold. J. Acoust. Soc. Am. 107 (1), 501–507 (2000).

Plomp, R., The negative effect of amplitude compression in multichannel hearing aids in the light of the modulation–transfer function. J. Acoust. Soc. Am. 83 (6), 2322–2327 (1988).

Ruggero, M.A., Robles, L. and Rich, N.C., Two–tone suppression in the basilar membrane of the cochlea: Mechanical basis of auditory–nerve rate suppression. J. Neurophys. 68, 1087–1099 (Oct. 1992).

Sachs, M.B., and Young, E.D., Effects of nonlinearities on speech encoding in the auditory nerve. J. Acoust. Soc. Am. 68 (3), 858–875 (1980).

Skinner, M.W., Speech intelligibility in noise–induced hearing loss: Effects of high–frequency compensation. J. Acoust. Soc. Am. 67 (1), 306–317 (1980).

Soli, S.D., Hearing aids: today and tomorrow. Echoes: The newsletter of The Acoustical Society of America, vol. 4, No. 3 (1994).

Valente, M., Fabry, D.A., Potts, L., and Sandlin, R.E., Comparing the performance of the Widex SENSO Digital hearing aid with analog hearing aids. J. Am. Acad. Audiol. 9, 342–360 (1998).

Villchur, E., Signal processing to improve speech intelligibility in perceptive deafness. J. Acoust. Soc. Am. 53, 1646–1657 (Jun. 1973).

* cited by examiner $$D(p) = \left(\frac{2}{\sqrt{\pi}}\right) \cdot \frac{\Gamma(1 + .5 \cdot p)}{\Gamma(1.5 + .5 \cdot p) \cdot 2^{0.5 \cdot (1-p)}}$$

HEARING AIDS BASED ON MODELS OF COCHLEAR COMPRESSION USING ADAPTIVE COMPRESSION THRESHOLDS

CROSS-REFERENCE TO RELATED APPLICATION

This is a continuation-in-part of U.S. patent application Ser. No. 09/158,411, filed Sep. 22, 1998 entitled "Hearing Aids Based On Models Of Cochlear Compression", the entire disclosure of which is hereby incorporated by reference.

STATEMENT REGARDING FEDERALLY SPONSORED RESEARCH

The present invention was developed in part through Grant No. 1R43DC04028-01 from the National Institute on Deafness and other Communication Disorders (NDICD) through the Small Business Innovation Research Program (SBIR). The United States Government may have some rights therein.

BACKGROUND OF THE INVENTION

1. Field Of The Invention

This invention relates to the field of electronic filters and amplifiers for electroacoustic systems such as hearing aids, and more particularly to methods and devices for correction and clinical testing of hearing impairment.

2. Description Of The Related Art

The need for improved hearing aids and audiological fitting procedures is widely attested to by research efforts worldwide. It has been said that over 28 million Americans have hearing impairments severe enough to cause a communications handicap. While hearing aids are the best treatment for most of these people, only about 5 million actually own hearing aids, and fewer than 2 millions are sold annually. In addition, less than 60% of hearing aid owners are actually satisfied with their hearing aids.

Hearing impairment is most commonly expressed as a loss of sensitivity to weak sounds, while intense sounds can be as loud and uncomfortable as in normal hearing. State-of-the-art hearing aids treat this phenomenon of "loudness recruitment" (or loss of dynamic range) with sound amplification that automatically decreases with sound amplitude. This technique, known as "wide dynamic range compression" (WDRC), compresses the range of normally experienced sound amplitudes to the smaller range required by the impaired ear. Loudness recruitment is the basic audiological problem addressed by modern hearing aids.

Broad agreement exists that the most general and potentially successful design is a multi-channel compressive hearing aid that addresses the compression needs of each band of audible frequencies. Sharp disagreement exists, however, whether the dynamic range compression should be rapid or slowly adapting (Villchur, E., *Signal processing to improve speech intelligibility in perceptive deafness*, J. Acoust. Soc. Am. 53, 1646–1657 (1973); Plomp, R., *The negative effect of amplitude compression in multichannel hearing aids in the light of the modulation-transfer function*, J. Acoust. Soc. Am. 83, 2322–2327 (1988); Plomp, R., *Noise, amplification, and compression: consideration of three main issues in hearing aid design*, Ear and Hearing 15, 2–21 (1994).

Thus, the best engineering approach to compression has been uncertain. Rapid compression amplifiers protect the ear from uncomfortable changes in loudness, but nonlinearly distort the sound waveform. Slowly adapting compression avoids distortion, but allows some loudness discomfort. Resolving these competing interests have plagued previous efforts to develop suitable hearing aids employing wide dynamic range compression (WDRC).

Recent advances in hearing aid development have been largely driven by availability of inexpensive miniaturized electronic analog and digital signal processors. The classical audiological problem of loudness recruitment, which older hearing aids solved with a manual volume control, is now solved with sound compression systems that automatically provide greater amplification for weak than for intense sounds. A recent comprehensive and authoritative review found that (1) "for speech in quiet at a comfortable level, no compression system yet tested offers better intelligibility than individually selected linear amplification" (i.e., manual volume control), and (2) "in broadband noise, only one system, containing wideband compression followed by fast acting high-frequency compression, has so far been shown to provide significant intelligibility advantages." (See Dillon, H., *Compression? Yes, but for low or high frequencies, for low or high intensities, and with what response times?*, Ear and Hearing 17, 287–307 (1996) [comments by Villchur, and reply by Dillon, 1997, in *Ear and Hearing,* 18:169–1731]).

The technology that has dominated public hearing aid research is linear amplification with sound level dependent gains that are adjusted either manually or automatically to provide the desired wide dynamic range compression (WDRC). The use of linear amplifiers has been the dominant compression technology for hearing aids, be they analog or digital, single or multiple channel (see Levitt, H., Pickett, J. M., and Houde, R. A., *Sensory Aids for the Hearing Impaired*, IEEE Press, NY. (1980); Goldstein, J. L., Valente, M., Chamberlain, R., *Acoustic and psychoacoustic benefits of adaptive compression thresholds in hearing aid amplifiers that mimic cochlear function*, J. Acoust. Soc. Am. vol. 109, p. 2355 (2001)).

Villchur's above-cited 1973 article proposes the use of adaptive linear compression to reduce the dynamic range of the fine structure of speech signals with greater amplification of weak than strong syllables. To achieve this result, the adaptive linear compression system disclosed by Villchur must use short release times. However, the use of short release times is less than desirable, because it causes excessive amplification of unwanted ambient sounds during normal pauses in speech.

Dillon's above-cited article also reviews the use of linear amplifiers to implement a WDRC system. In these systems, the "compression threshold" is the input sound level above which the gain of the linear amplifier is adapted to reduced linear gains.

An innovative design by Engebretson and Morley (See Engebretson, A. M., Morley, R. E., and Popelka, G. R., *Development of an ear-level digital hearing aid and computer assisted fitting procedure*, J. Rehab. Res. Devel., 24 (4), 55–64 (1987); U.S. Pat. No. 5,357,251 issued to Morley et al.) was an adaptive linear WDRC digital amplifier with four channels partitioning the audio frequency range of 375 Hz–6000 Hz into four octave bands. In this design, each channel is configured to provide maximum corrective gain for low amplitude signals. The corrective gain is reduced at larger amplitudes by adaptive linear amplification. The BPNL transducers are linear with symmetrical hard limiting, i.e., $T(x)=-T(-x)$ (defined as "odd symmetry"), which prevents even-order harmonics and intermodulation tones from being generated by limiting. The second filter in each channel reduces the odd-order distortion that is caused by the limiting. Considerable engineering sophistication was applied to the implementation of this design into a programmable, in-the-ear, practical digital hearing aid.

In common with other compressive hearing aids, the Engebretson and Morley design implements adaptive linear WDRC amplification of sounds using linear amplifiers. However, the normal cochlea employs essentially non-linear compressive sound amplification, which is degraded by sensorineural impairment to a linear residual response. Basic cochlear research has generated a rich body of experimental data on non-linear phenomenology whose salient features and interrelations have been described with mathematical models. (See Goldstein, J. L., *Modeling rapid compression on the basilar membrane as multiple-bandpass nonlinearity filtering*, Hear. Res. 49, 39–60 (1990); Goldstein, J. L., *Exploring new principles of cochlear operation: bandpass filtering by the organ of Corti and additive amplification by the basilar membrane*, In Duifhuis, H., Horst, J. W., van Dijk, P. and van Netten, S. M., Eds. Biophysics of Hair Cell Sensory Mechanisms. World Scientific, Singapore, pp. 315–322 (1993); Goldstein, J. L., *Relations among compression, suppression, and combination tones in mechanical responses of the basilar membrane: data and MBPNL model*, Hear. Res. 89, 52–68 (1995). The inventor herein has determined from these models that there is a need to depart from the conventional design implementing WDRC amplification with linear amplifiers.

The parent application (U.S. patent application Ser. No. 09/158,411 filed Sep. 22, 1998, the entire disclosure of which is incorporated by reference) discloses how the models may be used to: (1) specify the shape of quiescent compression characteristic to approximately restore the normal cochlear best frequency response; (2) implement compression rapidly with instantaneously responding, memoryless compressive transducers derived from cochlear models; and (3) enhance the properties of instantaneous compression by adopting the cochlear strategy of non-linearly mixing linear and compressive responses. The parent invention improved on the Engebretson and Morley design by employing at least one variable gain channel comprising a linear transmission path of constant gain, a compressive transmission path of higher gain than the linear transmission path, and a non-linear adder combining the outputs of the linear in the compressive transmission paths, wherein the variable gain channel is configured to provide relatively higher gain at low levels, rapid gain compression at intermediate levels converging to linear gain at high signal levels, and slow AGC control of the compressive gain.

The invention disclosed in the parent application, among other things, provides two types of enhancements over conventional linear WDRC models: (1) restoration of waveform modulation lost in rapid compression, and (2) reduction in amplification of unwanted background noise in the presence of more intense desired signals.

In subsequent research, it was discovered by the inventor herein that both enhancement goals can be achieved by adapting the compression thresholds of the memoryless compressive non-linear transducers. (See Goldstein, J. L., Valente, M., Chamberlain, R., Gilchrist, P., and Ivanovich, D., *Pilot experiments with a simulated hearing aid based on models of cochlear compression*, IHCON 2000, Lake Tahoe, Calif. (2000); and the above-cited 2001 article by J. Goldstein) This adaptation is functionally similar to modifications in the normal cochlear response produced by "tail suppression" (for a fuller understanding of "tail suppression", see Kiang, N. Y. S. and Moxon, E. C., *Tails of tuning curves of auditory-nerve fibers*, J. Acoust. Soc. Am. 55, 620–630 (1974); Abbas, P. J. and Sachs, M. B., *Two-tone suppression in auditory-nerve fibers: Extension of stimulus response relationship*, J. Acoust. Soc. Am. 59, 112–122 (1976); Duifhuis, H., *Level effects in psychophysical two-tone suppression*, J. Acoust. Soc. Am. 67, 914–927 (1980); Ruggero, M. A., Robles, L. and Rich, N. C., *Two-tone suppression in the basilar membrane of the cochlea: Mechanical basis of auditory-nerve rate suppression*, J. Neurophys. 68, 1087–1099 (1992); and efferent mechanical control (for a fuller understanding of efferent mechanical control, see Mountain, D. C., *Changes in endolymphatic potential and crossed olivocochlear stimulation alter cochlear mechanics*, Science 210, 71–72 (1980); Gifford, M. L., and Guinan, J. J., *Effects of crossed-olivocochlear-bundle stimulation on cat auditory nerve fiber responses to tones*, J. Acoust. Soc. Am. 74, 115–123 (1983); Murugasu, E., and Russell, I. J., *The effect of efferent stimulation on basilar membrane displacement in the basal turn of the guinea pig cochlea*, J. Neurosci. 16, 325–332 (1996).

Studies by the inventor have shown that when processing clean speech (speech in a relatively quiet environment having little or no unwanted background noise), the compression threshold can be maintained at a predetermined quiescent level with the result being little or no degradation in sound quality. This result generally holds true when the compression threshold is between a range of the predetermined quiescent level and about 20 decibels below the average sound level of the received sound signal.

However, when that same speech is processed by the hearing amplification device in a relatively noisy environment, the sound quality of the amplified sound signal (now containing the speech plus background noise) resulting from the static predetermined quiescent compression threshold is less than optimal due to overamplification of the background noise. In other words, the signal-to-noise ratio (SNR) of the sound signal is degraded by the amplifier.

The inventor herein has found that by adjusting the compression threshold from its quiescent level to a range between about 5 decibels below and about 5 decibels above the average sound level of the received sound signal, overamplification of unwanted background noise in the sound signal can be reduced while still maintaining appropriate amplification of the desired speech.

Therefore, by adapting the compression threshold of the linear-to-compressive gain characteristic, the present invention provides an elegantly simple implementation for enhancing rapid and instantaneous compressive amplification that mimics useful cochlear function while avoiding its complex structure.

SUMMARY OF THE INVENTION

Accordingly, provided herein is an improvement for a hearing amplification device adapted to receive a sound signal and having at least one channel configured to receive an input representative of the sound signal, the improvement comprising at least one channel being configured to provide (1) linear gain for an input representative of a portion of the sound signal having a sound level less than a compression threshold, (2) rapid compressive gain for an input representative of a portion of the sound signal having a sound level greater than said compression threshold, wherein the rapid compressive gain is less than the linear gain, and (3) adaptive control of the compression threshold.

Preferably, the rapid compressive gain is implemented as instantaneous compressive gain. When the compressive gain is said to be instantaneous, what is meant is that the input/output relationship is number in/number out; essentially, the compression is memoryless in that the output does not depend upon previous inputs. Rapid compression refers to compression where there is a negligible delay such as through capacitor charging, but the delay is shorter than the reciprocal of the bandwidth of the sound signal processed by the device.

Adaptive control of the compression threshold can be implemented with a compression threshold controller. This compression threshold controller, when coupled to a transducer having the above-described linear-to-compressive gain characteristic, can adjust the compression threshold as needed.

For example, the compression threshold can be adjusted at least partially in response to changes in the sound signal received by the hearing amplification device. Also, the compression threshold can be adjusted in response to a user input. In certain situations, it may be desirable to either not adjust the compression threshold (either hold it at its predetermined quiescent level or fix it at its current level). For example, when a user is listening to a sound signal in a noise-free environment (wherein a static compression threshold will still provide acceptable results), no adjustments may need to be made. The same situation may also exist when a user wishes to listen to background noise rather than the dominant speech signal components of the sound signal.

Thus, the compression threshold controller can be implemented with at least two operating modes: (1) a first operating mode providing no adjustments to the compression threshold (meaning that the compression threshold remains fixed at its predetermined quiescent level), and (2) a second operating mode providing adjustments of the compression threshold at least partially in response to changes in the sound signal. By switching between the operating modes, the hearing amplification device can provide optimal performance in both quiet and noisy environments. The switching between operating modes can be performed in response to a user input (such as a manual switch) or can be done automatically in response to detection of various characteristics of the received sound signal (i.e. the amount of background noise present).

Also, it is preferable that the compression threshold controller further have a third operating mode to which it may be switched, wherein the compression threshold is fixed at its current level. This mode may be desirable when a user finds that the hearing amplification device is currently providing satisfactory results and wants to ensure that the hearing amplification device stays in that state for an extended period of time. The third operating mode (or the first operating mode in a manually-switched compression threshold controller) may also be desirable when a user wants to listen to the background noise rather than the dominant speech signal. For example, in a noisy setting such as a cocktail party, the user of the hearing amplification device may wish to listen in on side conversations rather than a main conversation. To do so, the user can maintain the compression threshold at its quiescent level (via the first operating mode) or at a fixed level near the quiescent level (via the third operating mode) to thereby cause high amplification of background noise relative to the dominant speech signal.

As explained above, the inventor has found that when a user is in a noisy environment, optimal results can be achieved by adjusting the compression threshold to be within a range of about 5 decibels below the average sound level of the sound signal to about 5 decibels above that average sound level. The average sound level of at least a portion of the received sound signal can be estimated through a variety of methods. In one preferable method, the inventor herein has found experimentally that speech signals tend to have a 7:1 correlation between peak value and RMS level. Thus, by determining a peak value for at least a portion of the sound signal, the average sound level can be estimated by dividing the peak value by 7.

Also, it is preferable that the linear-to-compressive gain characteristic further provide a constant gain (preferably at or around unity gain) for an input representative of a portion of the sound signal having a sound level greater than a decompression threshold (thereby making the gain characteristic a linear-to-compressive-to-unity gain characteristic). The compressive gain will converge to the constant gain for increasing sound levels, and the decompression threshold will be greater than the compression threshold. The decompression threshold is the breakpoint between compressive gain and unity gain in terms of the sound level of the received sound signal. Providing constant gain at or around unity for relatively loud sound signals allows the hearing amplification device to mimic the hearing characteristic of most normal hearing persons, wherein loudness recruitment is experienced at high sound levels, typically above 90 dB SPL. As the preference of hearing impaired individuals for normal loudness recruitment is unknown, a user option is provided for compressive amplification without the decompression.

Additionally, to improve the hearing comfort of a user of the present invention, the gain characteristic can further provide attenuation for an input representative of a portion of the sound signal having a sound level greater than an attenuation threshold, wherein the attenuation threshold is greater than the decompression threshold. Preferably, the attenuation threshold is set to match the sound level of uncomfortably loud sound signals (typically 100–110 dB SPL). Thus, when an uncomfortably loud sound signal is received by the hearing amplification device, that sound signal will be attenuated before being passed on to the user, thereby improving the comfort provided by the present invention.

Furthermore, the inventor has discovered that by providing a smooth transition between the linear gain region and the compressive gain region, the intelligibility of the resultant amplified sound signal is greatly improved. Testing conducted by the inventor has shown that when a sharp transition is provided between linear and compressive gain, intelligibility of the resultant amplified sound signal decreases by about 20% from intelligibility when a smooth transition is provided. However, due to the increased complexity that may be involved in some implementations of a smooth transition between linear and compressive gains, a sharp transition may be desirable in some situations, for example, for teaching purposes. Transducers with sharp transitions are convenient engineering representations of transducers, whether they be implemented with smooth or sharp transitions.

It is preferable that the hearing amplification device be implemented with a plurality of the above-described channels, each of which being responsive to a different audio frequency range. The compression threshold of each channel can be independently set and independently controlled. That is to say, each channel may or may not have the same predetermined quiescent compression threshold. Also, each channel may adjust its compression threshold differently in response to the control signal received from the compression threshold controller.

The present invention can be implemented using either analog or digital components. A preferable implementation is in a digital signal processor (and even more preferably, a multirate digital signal processor).

Adjustments of the compression threshold in response to changes in the sound signal can be carried out with an algorithm wherein the compression threshold is (1) instantly increased in response to an increase in the peak value of successive sound signals, (2) maintained at its current value in response to minor fluctuations in the peak value of successive sound signals, and (3) decreased in response to continuous drops in the peak value of successive sound signals. Preferably, compression threshold reductions are carried out with slow release times so that the compression threshold is not prematurely dropped to a low level wherein background noise will be overamplified during the brief pauses that exist during normal speech.

Also provided herein is a method of diagnosing an extent and form of hearing impairment, the method comprising: (a) determining an amount of low level gain $G_1$ needed by a patient for sound signals having a low sound level; (b) selecting a compression power p; (c) adjusting a hearing amplifier device to provide the determined low level gain $G_1$ and selected compression power p, the hearing amplification device being configured to process an input signal representative of a sound signal according to a gain characteristic, the gain characteristic defined by (1) linear gain for inputs representative of a sound signal having a sound level less than a compression threshold, (2) rapid compressive gain for inputs representative of a sound signal having a sound level greater than a compression threshold; (d) presenting sound signals at an input of the hearing amplification device; (e) providing to the patient an output from the hearing amplification device that is generated from the presented sound signal; (f) adjusting the values of the low level gain $G_1$, the compression power p, and the compression threshold until the patient communicates that he or she has perceived satisfactory results.

Also, the present invention of adaptive compression thresholds, which enhances the performance of instantaneous compressive amplifiers, can be exploited as well for adaptive linear systems. By adapting the quiescent threshold with relatively long release times, the WDRC system can focus more responsively on a reduced compressive range.

These and other features and advantages of the present invention will be in part apparent and in part pointed out hereinafter.

DETAILED DESCRIPTION OF THE PREFERRED EMBODIMENT

As used herein, a "hearing amplification device" refers to a hearing aid, a hearing aid fitting device (i.e., a testing device used to select appropriate characteristics of a hearing aid for hearing impaired individual), or a hearing diagnostic device.

Figure 1:
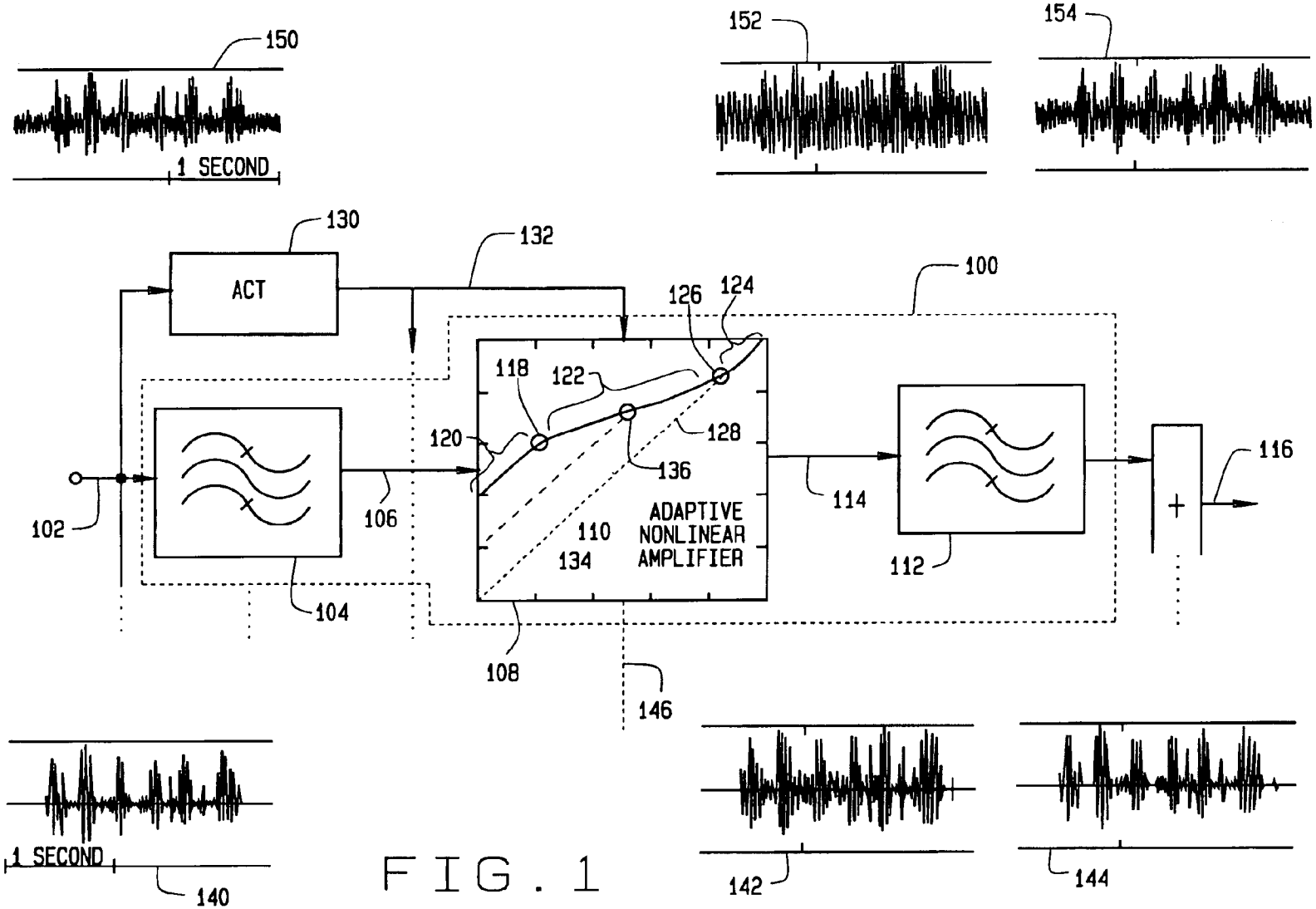
FIG. 1 is a simplified block diagram of a cochlear-based paradigm for hearing aid amplification in accordance with the present invention illustrating the effects of instantaneous wide dynamic range compression and adaptively controlled compression thresholds for speech waveforms.

FIG. 1 shows a simplified block diagram of a preferred embodiment of a cochlear-based paradigm for hearing aid amplification in accordance with the present invention. One channel 100 is illustrated in FIG. 1, although it is indicated by the dashed lines that a hearing aid or diagnostic device may preferably be provided with a plurality of channels, each acting on different audio frequency ranges. Usually, the audio frequency ranges will comprise contiguous bands covering the useful audio range, but this may depend upon the gain correction required. Preferred analog and digital implementations are discussed in conjunction with other figures presented herewith, but FIG. 1 conveniently serves to explain the general principles and performance of the invention. In particular, the accompanying speech waveforms shown in FIG. 1 illustrate key performance benefits of the invention.

In the amplification channel 100, a sound pressure signal is converted by a conventional transducer (such as a microphone, which is not shown) to a suitable signal that is applied to the channel input 102. This signal is passed through a bandpass filter 104 which is configured with a pass band in the frequency range of channel 100. Other channels would also have corresponding bandpass filters configured with pass bands matching the frequency ranges of their respective channels. The signal from the output 106 of the bandpass filter 104 is applied as an input to the adaptive nonlinear amplifier 108, which provides instantaneous wide dynamic range compression illustrated by solid line 110 which identifies the gain characteristic for amplifier 108 as a function of input sound level.

The gain characteristic of the nonlinear amplifier in each channel is set to correct the average hearing loss of a hearing impaired individual for that channel's band of frequencies, and to provide compensation for loss of normal cochlear compression, as described in detail below in conjunction with other figures. A second bandpass filter 112, similar to the first bandpass filter 104, receives the amplified output 114 of the nonlinear amplifier 108 and reduces undesired nonlinear distortion. Preferably, bandpass filter 112 is tuned the same as bandpass filter 104. The amplified outputs 114 of all channels are added to form the aggregate amplified signal 116 that drives a conventional transducer (such as an earphone transmitter, which is not shown) that creates an acoustic signal for the ear canal from the aggregate amplified signal.

Key features of the nonlinear amplifier 108 are instantaneous sound compression, with an adaptive compression threshold. The design of amplifier transfer functions which provide instantaneous wide dynamic range compression (IWDRC) is described in later figures. The solid curve 110 in FIG. 1 illustrates (with log-log coordinates) an example of a quiescent IWDRC transfer function (prior to adaptation). Dashed line 128 identifies a maximally adapted response (gain=1) wherein the compression threshold has been upwardly adjusted to its maximum value—the decompression threshold 126.

The transfer function illustrated by curve 110 provides linear gain over region 120 (which is a range of input sound levels receiving linear gain, the upper end point of the range being the quiescent compression threshold) for amplifier inputs having a relatively low amplitude (an amplitude less than compression threshold 118), instantaneous compressive gain over region 122 (which is a range of input sound levels receiving instantaneous compressive gain, the endpoints of the range being the quiescent compression threshold and the decompression threshold) for amplifier inputs having a relatively moderate amplitude, and substantially unity gain over region 124 for amplifier inputs having a relatively high amplitude (an amplitude greater than decompression threshold 126). The amplitude of the input signal corresponds to the sound level of the sound signal received by the hearing amplification device. Thus, the transfer function of amplifier 108 can be defined in terms of its response to the sound level of the received sound signal.

The compression threshold 118 defines the transition point from substantially linear gain for relatively low level sound signals to substantially compressive gain for relatively moderate level sound signals. As explained in more detail below, the transition from linear gain over region 120 to instantaneous compressive gain over region 122 is preferably a smooth transition (note the gradual compression shown by curve 110 around the compression threshold 118). The compressive range (region 122) extends from the compression threshold 118 to the decompression threshold 126. The decompression threshold 126 defines the transition point from substantially compressive gain for relatively moderate level sound signals to substantially linear gain (in this case unity gain) for relatively high level sound signals. The compression shown in FIG. 1 over region 122 is cube root compression.

Adaptive control of the compression threshold 118 is provided by the compression threshold controller 130 (labeled ACT for adaptive compression threshold). In a preferred embodiment, the controller 130 receives and processes an input corresponding to the sound signal received by the hearing amplification device, and adjusts the compression threshold 118 via control signal 132 in response to changes in the sound signal (for example, changes in the RMS level of the sound signal). The compression threshold may be adjusted to a value in the range between the initially set quiescent compression threshold 118 and the decompression threshold.

Dashed curve 134 illustrates the amplifier transfer function resulting from an upward adjustment of the compression threshold from its quiescent level 118. By upwardly adjusting the compression threshold, the compressive range is reduced to the range between new compression threshold 136 and decompression threshold 126. As is apparent from FIG. 1, a decrease in the compressive range through upward adjustment of the compression threshold, increases the range of low level linear gain, thereby creating a wide range of input sound amplitudes that will receive the higher gain of the linear range (relative to the compressive range). However, such an upward adjustment of the compression threshold will also decrease the magnitude of linear gain. As stated above, dashed line 128 identifies the maximum upward adaptation allowed for the compression threshold. In this maximally adapted state, the linear gain has been decreased to unity and the compressive range has been eliminated.

Figure 22:
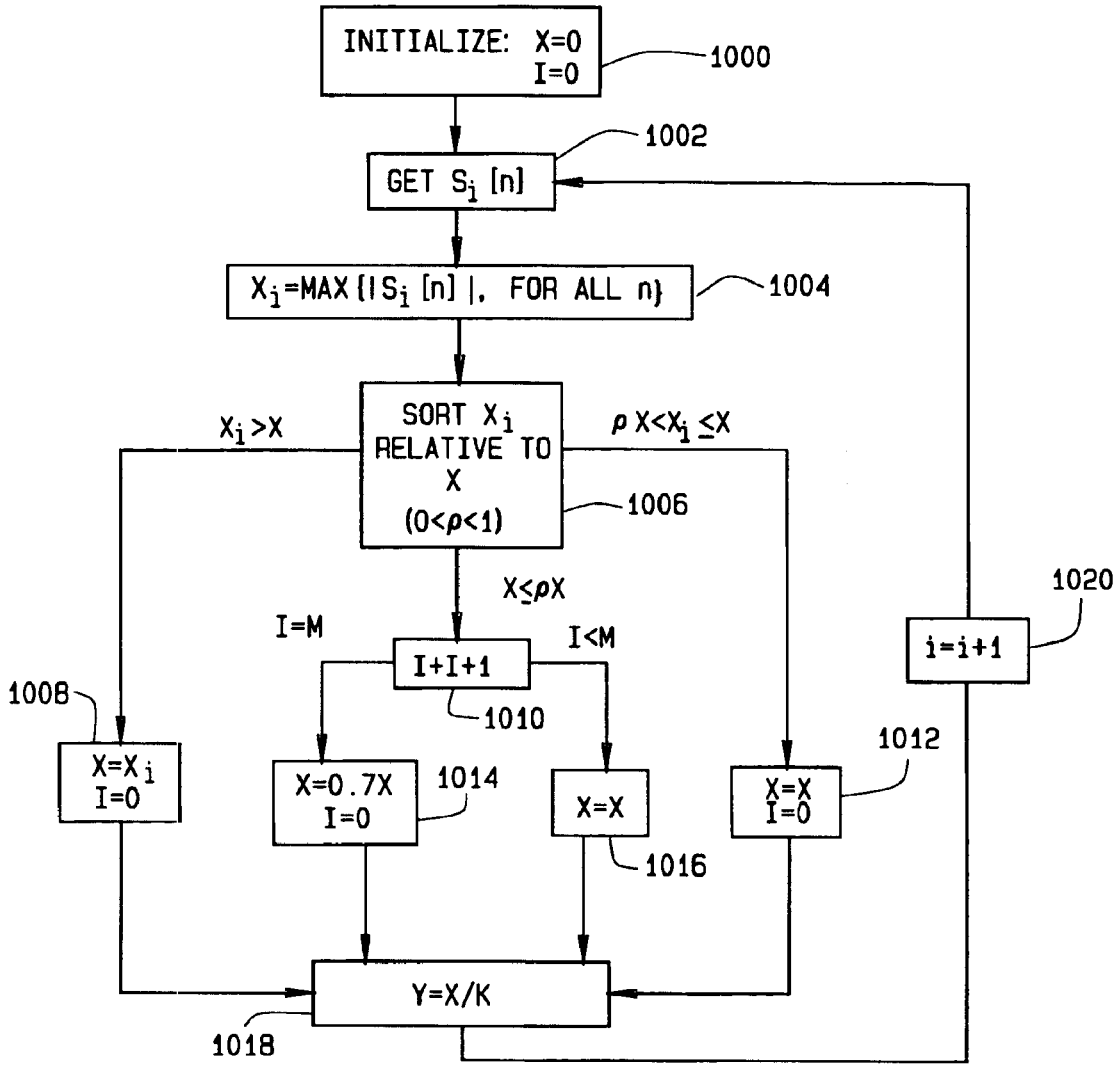
FIG. 22 is a flow chart for the preferred operation of the compression threshold controller.
Figure 23:
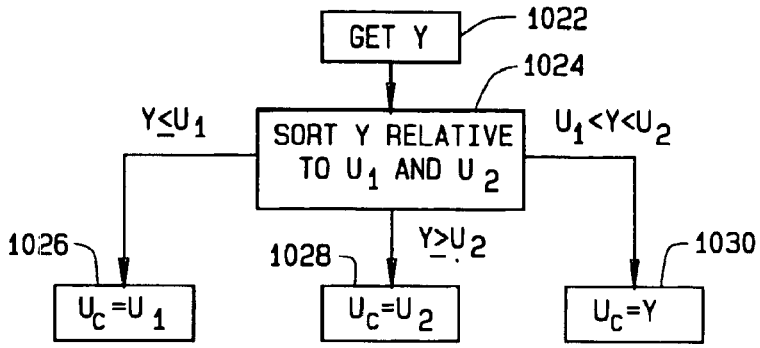
FIG. 23 is a flow chart for the preferred response of each channel to the controller.

Control signal 132 is preferably provided to each channel, wherein the amplifier of each channel may process that control signal differently in determining how that channel's compression threshold should be adjusted. FIGS. 22 and 23 address the creation of the control signal 132 and how that control signal is processed by each amplifier.

The speech waveforms in FIG. 1 illustrate the acoustic effects on speech of nonlinear amplification with a six octave-band system (six channels) covering the audio range of 125 Hz to 8 kHz. The speech signal 140, shown at lower left, is a low predictability test sentence from the "revised speech perception in noise" corpus (R-SPIN: See Kalikow, D. N., Stevens, K. N., and Elliot, L. L., *Development of a test of speech intelligibility in noise using sentence materials with controlled word predictability*, J. Acoust. Soc. Am. 61, 1337–1351 (1977); Bilger, R. C., Nuetzel, J. M., Rabinowitz, W. M., and Rzeckowski, C., *Standardization of a test of speech perception in noise*, J. Speech Hear. Res. 27, 32–48 (1984)): "Miss White won't think about the crack." Speech signal 140 is relatively clean (low noise) speech as illustrated by the almost negligible low level components of the speech signal.

Two normalized response waveforms 142 and 144 for the speech signal 140 are shown at the lower right; waveform 142 results from passing clean speech signal 140 through an amplifier configured with the quiescent transfer function of curve 110 having the quiescent compression threshold 118, and waveform 144 results from passing clean speech signal 140 through an amplifier configured with the adapted transfer function of curve 134 having the adapted compression threshold 136. The average sound level of clean speech signal 140 is near the middle 146 of the (abscissa) scale for the nonlinear amplifier, well above the quiescent compression threshold 118.

When the amplifier 108 is configured to have the quiescent transfer function of curve 110, much of the speech signal 140 lies above the quiescent compression threshold 118, which results in much of the speech signal 140 receiving compressive gain from the amplifier. As a result, greater amplification will be provided to weaker components of the speech signal than to stronger components of the speech signal (due to the larger gain of the linear region—the amount of gain at any point on curves 110 and 134 can be determined as the Y-axis distance between that point on curve 110 or 134 and the point on unity line 128 sharing the same X-axis coordinate). Greater amplification of weaker segments of a signal constitutes waveform compression. For clean speech signals, waveform compression raises the relative levels of weak syllables, as can be seen by a comparison between waveform 142 and speech signal 140.

However, when the compression threshold is adjusted by controller 130 to be compression threshold 136 of curve 134, the response waveform 144 and speech signal 140 are more closely matched. Waveform 144 more closely matches speech signal 140 than does waveform 142 because when speech signal 140 is processed according to the adapted transfer function defined by curve 134, a larger portion of the speech signal 140 receives the uniformity of linear amplification (there is a narrower compressive range).

Despite the differences between waveforms 142 and 144, informal comparisons of the audio outputs corresponding to those waveforms by normal hearing subjects revealed little or no audible differences between the two waveforms. Severely hearing impaired subjects may benefit from this effect of waveform compression, because of their reduced dynamic range. However, the effect of waveform compression from nonlinear amplifier 108 behaves very differently for a noisy speech signal 150, as illustrated at the top right of FIG. 1.

Noisy speech signal 150 includes 12-speaker babble noise, added with an RMS signal-to-noise ratio (SNR) of 8 dB. Two normalized response waveforms 152 and 154 for noisy speech signal 150 are shown at the upper right; waveform 152 results from passing noisy speech signal 150 through an amplifier configured with the quiescent transfer function of curve 110 having compression threshold 118, and waveform 154 results from passing noisy speech signal 150 through an amplifier configured with the adapted transfer function of curve 134 having adapted compression threshold 136.

When the amplifier 108 is configured to have the quiescent transfer function of curve 110, as with the clean speech example, much of the background noise will be amplified a greater amount than the dominant speech signal, as shown by waveform 152 which illustrates poor contrast between the dominant speech signal and the background noise due to the background noise being amplified greater than the dominant speech signal.

However, when the compression threshold is adjusted by controller 130 to be compression threshold 136 of curve 134, the response waveform 154 and noisy speech signal 150 are more closely matched because the upward adjustment of the compression threshold results in a wider linear range (albeit with less gain) and a narrower compression range. Because the linear range now extends to higher level components of the noisy speech signal 150, much more of the noisy speech signal 150 will receive uniform linear amplification, thereby preventing the background noise from gaining too much ground on the dominant speech signal.

The inventor herein has determined that the differences in perceptual sound quality between the audio outputs resulting from waveforms 152 and 154 are striking. Thus, it is clear that adaptive control of the compression threshold provides improved sound quality in many situations, especially in situations where conversations occur in a noisy environment.

An important feature of the present invention is based on salient functional properties of cochlear nonlinear sound processing, which have been extensively modeled and described using relatively complex designs. The present invention provides a major simplification in the implementation of cochlear-based hearing aids by using an adaptively-controlled compression threshold that is believed to mimic relevant aspects of normal cochlear function, while avoiding its complex structure.

Figure 2:
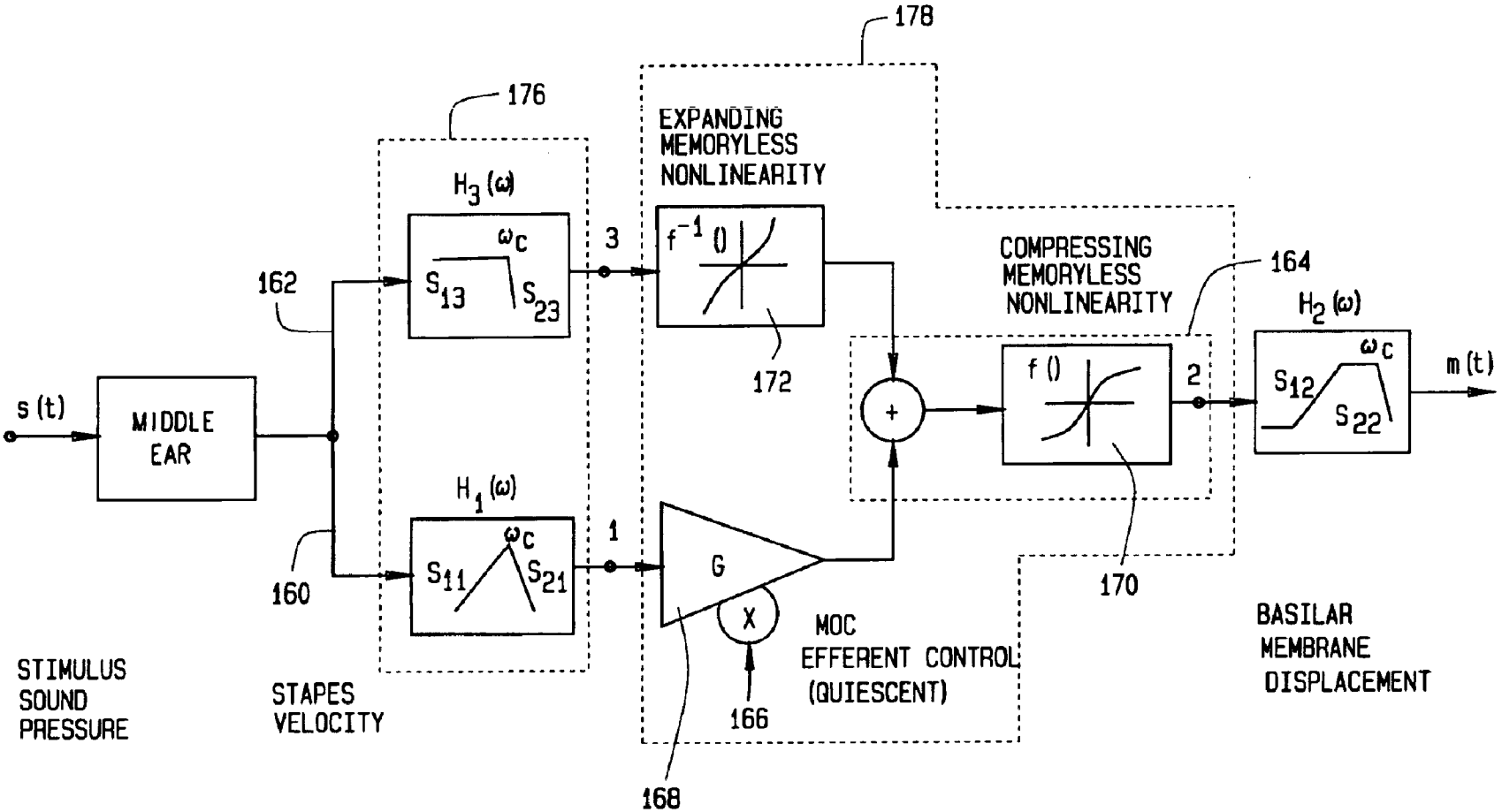
FIG. 2 is a block diagram of a multiple-band-pass-non-linearity (MBPNL) cochlear filter bank hearing model.

FIG. 2 is a foundational model from which the present invention has developed. FIG. 2 depicts a multiple band-pass non-linearity (MBPNL) filterbank model of cochlear mechanical compressive response. The model has explicit signaling paths 160 and 162 for the "tip" and "tail" components respectively of cochlear response. The "tip" path 160 is the primary signaling path in the healthy cochlea. "Tip" path 160 is modeled as a band-pass-non-linearity (BPNL) compressive amplifier, with linear response at low signal levels. The "tail" path 162 provides broadband linear signaling, which can become the dominant signal in the impaired cochlea, wherein loss of outer hair cell function degrades or eliminates the "tip" response. This latter property is the basis for understanding loudness recruitment, and loss of normal adaptive function.

A key feature of the model shown in FIG. 2 is the nonlinear mixing (164) between the "tip" and "tail" paths. The nonlinear mixing provides feedforward suppression by low frequency "tail signals" that can enhance "tip" processing. Studies have shown that nonexcitatory tail suppression enhances cochlear frequency-response profiles for speech signals. However, studies have also shown that at increasing sound levels, the tail signal can become excitatory and displace the desired tip signal. A second mechanism for modifying "tip" processing represented by the model, is efferent feedback-control 166 of the "tip" amplifier 168. The efferent feedback is likely to be intelligently controlled for the listening task, and sustained during interruptions of the tail signal. The rapid cochlear compression is modeled with two nonlinear transducers 170 and 172 that are memoryless, while all the frequency filters $H_1(\omega)$, $H_2(\omega)$, and $H_3(\omega)$ are linear (with memory).

The present invention implements the cochlear-based model shown in FIG. 2 with a first filter (filter 104 in FIG.

1) that simulates filters $H_1(\omega)$ and $H_3(\omega)$ identified by dashed box 176, a second filter (filter 112 in FIG. 1) that simulates $H_2(\omega)$), and a nonlinear amplifier (amplifier 108 in FIG. 1) under adaptive control of its compression threshold that simulates the elements comprising dashed box 178. The nonlinear mixing between tip and tail signal processing paths is the basis for cochlear adaptive control of its compressive mechanical response. The transfer functions having the adaptive compression threshold shown in FIG. 1 simulate the modifications produced by tail suppression and efferent control, and it is likely that the two functions normally are biophysically interdependent, whereby it is hypothesized by the inventor that the efferent nerve controls the discharge of slow outer hair cell potentials that are created by strong tail signals.

In the model shown in FIG. 2 the tail signal biases the compressive transducer, thereby reducing the gain for weaker segments of the tip signal. Adaptive compressive amplifiers can be designed using signal-dependent biases to implement the properties shown in FIG. 1. The bias could be a nonlinearly processed, rectified and smoothed version of the tail signal. The "DC" tail bias would upset the odd symmetry of the MBPNL tip response.

Figure 3:
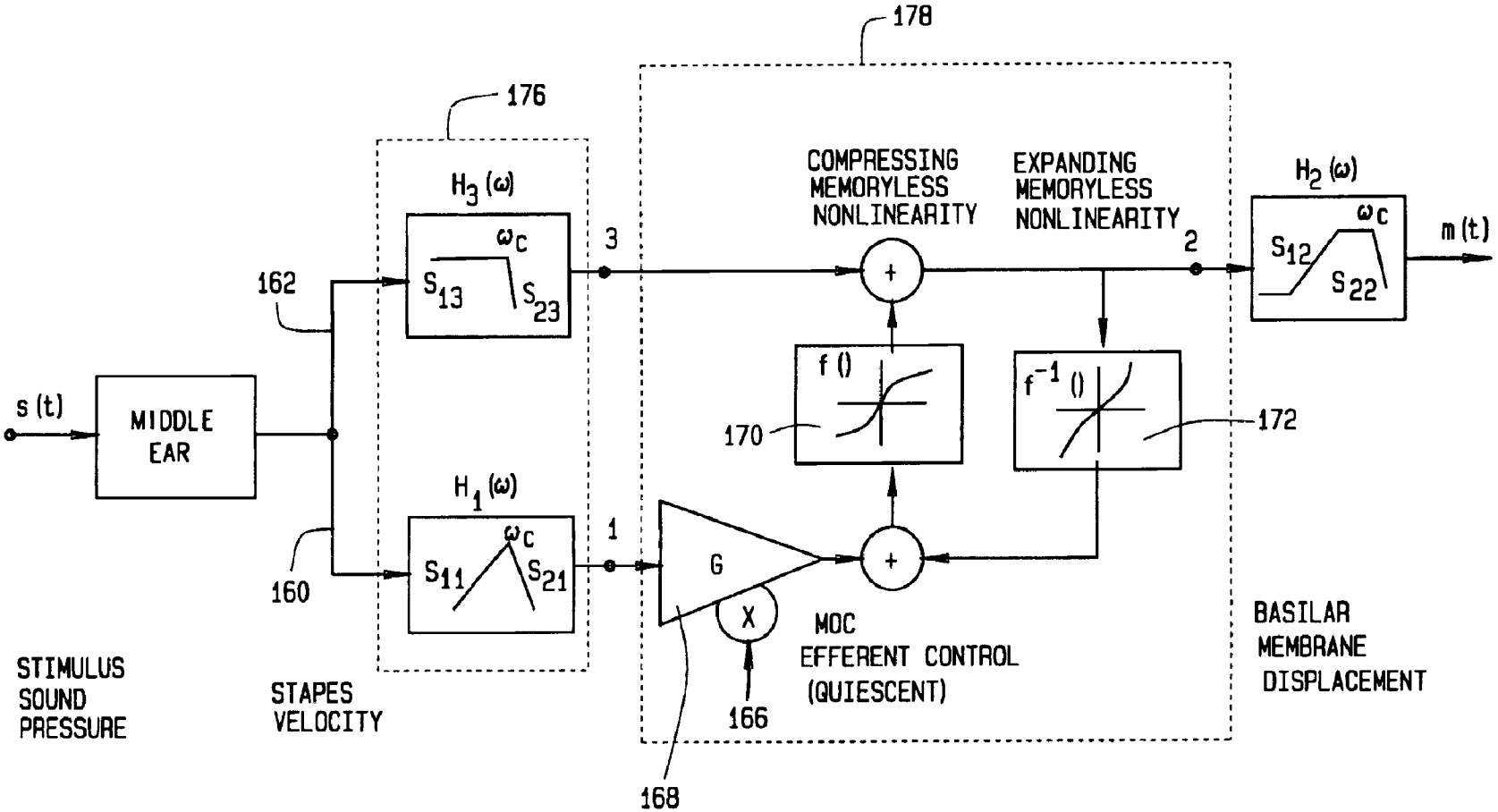
FIG. 3 is a block diagram of a multiple-feedback-band-pass-non-linearity (MFBPNL) cochlear filter bank hearing model.

A better result is obtained with the MFBPNL model shown in FIG. 3, which is a more-advanced feedback version of the MBPNL model. The model of FIG. 3 preserves the odd symmetry of the tip response in the presence of "DC" tail signals. Except for the feedback arrangement of the transducers 184 and 186, all elements in the MFBPNL and MBPNL models are identical, as described in connection with FIG. 2. However, having identified the desirable cochlear signal processing properties, the inventor herein has judged that the complex cochlear structure is not the preferred engineering implementation for adaptive hearing aid amplification. Thus, in the present invention, a signaling path (shown in FIG. 1), wherein the adaptive nonlinear amplifier is generally implemented as a cascade of simpler transducers, each of a form similar to the nonlinear transducers in the MBPNL model of FIG. 2, is used as opposed to a linear path and a compressive path whose outputs are nonlinearly mixed.

As described above, the transfer functions of the present invention are linear for small signals and sign-preserving power-law compressive for larger signals. A generalized class of these functions can be defined to provide arbitrary rates of smooth transitions between linear and compressive responses. These functions $f(u,u_o,p)$ and its inverse $f^{-1}(u_i, u_o,p)$ are defined as follows:

$$f(u, u_o, p) = u_o \operatorname{sgn}(u_o)\left[\left(1 + \left(\frac{u}{u_o}\right)^{2n}\right)^p - 1\right]^{\frac{1}{2n}}; \text{ and}$$

and $$f^{-1}(u,u_o,p)=f(u,u_o,1/p)$$

where: p=compression power (typically between ½ and ¼,

1/p=compression ratio (CR), u=instantaneous input amplitude, $u_o$=a normalization coefficient, n=an integer determining the smoothness of the transition from linearity to compression.

A family of merging transfer functions, in accordance with the present invention, is obtained from $f(uG_i,u_i,p)$, wherein the instantaneous input amplitude, u, is amplified by $G_i$, and by requiring the following relationship between $G_i$ and $u_i$:

$$u_i = u_o G_i^{\frac{-p}{1-p}}$$

The small signal gain for any $G_i$ is given by:

$$\text{Small Signal Gain} = p^{\frac{1}{2n}} G_i,$$

which approaches $G_i$ for large n.

An alternative algorithmic implementation of the family of merging transducer functions is also provided, which is preferred when the basic transducer is realized with an optimized analog or digital module. The module maintains a fixed transducer function and uses pre- and post-amplification $G_a$ and $G_b$ that depend upon $G_i$:

$$G_a = G_i^{\frac{1}{1-p}},\ G_a G_b = G_i$$

Empirical constraints have been discovered for the smoothness of the transition from linear response to compressive response. Cochlear response functions for simple tone signals are well represented with the choice of the smoothness parameter, n, being set to 2. Pilot psychophysical study of speech intelligibility for normal-hearing listeners with the amplifier described in FIG. 1 have demonstrated significantly better performance (80% vs. 60%) when a smooth transition is provided between the linear region and compressive region (n=2), as opposed to a sharp transition (a sharp transition being a transition having a discontinuous derivative) wherein "n" is large ($n \rightarrow \infty$).

The sharp transition was implemented as a seamed function, comprising the small and large signal asymptotes, the small signal asymptote being the linear region and the large signal asymptote being the straight line approximation of the compressive region. Independently of the smoothness of the transition, it is convenient to define the compression threshold for nonlinear transducer response as the input level at which the small and large signal asymptotes intersect. Thereby, the smooth transitions between linear and nonlinear responses in FIG. 1 are generalized to arbitrary smoothness.

The asymptotic transducer (sharp transition transducer) is fully defined by a small signal gain, A, and the linear/nonlinear compression threshold $U_c$, as follows:

$$TA(u, A, U_c, p) = A \cdot u, \text{ for } |u| < U_c;$$

$$= \operatorname{sgn}(u) \cdot A \cdot U_c \left|\frac{u}{U_c}\right|^p,$$

otherwise.

An explicit relation exists between the parameters of the asymptotic and smooth transducers as follows:

$$G_i = A \cdot p^{\frac{1}{2n}};$$

and $$u_i = U_c \cdot A \cdot p^{\frac{p}{2n(1-p)}}$$

Note that the factor involving p converges to unity with increasing n. It will be seen that the asymptotic transducer is convenient for engineering design.

Figure 4:
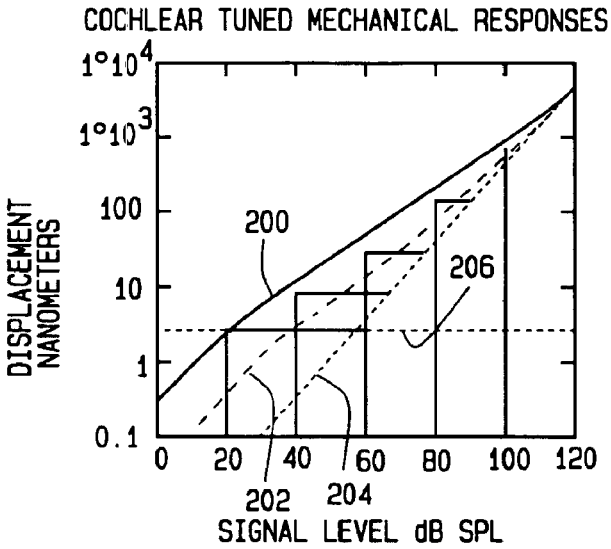
FIG. 4 is an illustration of a family of tuned best-frequency cochlear mechanical responses.

A family of "best frequency" cochlear model responses is shown in FIG. 4. These tuned cochlear responses represent the most sensitive response to a pure tone at a given frequency. Line 200 represents the response of a normal cochlea; it is linear at low and high signal levels, and smoothly joined with a wide compressive range. Line 202 represents the response of a mildly impaired cochlea, and identifies a common recruitment situation requiring correction of reduced sensitivity and compressive range. Line 204 represents the response of a moderately impaired cochlea. The sensitivity at lower signal levels is further reduced, and the compressive response is eliminated. The horizontal axis represents the sound pressure signal level in dB, while the vertical axis is a logarithmic scale representing cochlear displacement in nanometers. Observations by the inventor herein confirms that a compressive breakpoint occurs in the impaired cochlea at a nearly fixed level that is evident from lines 200, 202, and 204. This level is shown by horizontal line 206.

Figure 5:
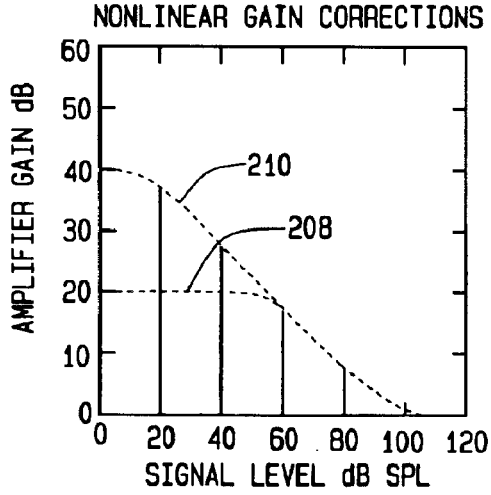
FIG. 5 is a drawing showing the required nonlinear gain corrections for both the mildly impaired cochlea and the moderately impaired cochlea of FIG. 4.

FIG. 5 shows the required nonlinear gain corrections, for both the mildly impaired cochlea and the moderately impaired cochlea of FIG. 4. The gain correction required for the mildly impaired cochlea is represented by curve 208 while the gain correction required for the moderately impaired cochlea is represented by curve 210. These curves are derived from FIG. 4 by noting the horizontal distance in dB between the responses of the healthy and the impaired cochleae at the signal levels in dB shown. For example, at 20 dB SPL in FIG. 4, curve 200, representing the response of a healthy cochlea, shows a displacement of about 2.5 nanometers. A gain of slightly less than 40 dB is required to provide the same displacement for the moderately impaired cochlea, while a gain of only 20 dB is required for the mildly impaired cochlea. At 40 dB SPL, a gain of slightly less than 30 dB is required for the moderately impaired cochlea, while a gain of 20 dB still suffices for the mildly impaired cochlea. At about 60 dB SPL, the gain required for both the mildly and the moderately impaired cochlea is about 20 dB. As can be seen at greater SPLs, the required gain is essentially the same for both the mildly and moderately impaired cochlea, and this gain diminishes as SPL increases, approaching 0 dB for levels above approximately 100 dB SPL.

One significant observation, for purposes of the present invention, is that the amplification amounts needed for correction of different levels of impairment severity surprisingly merge (i.e., the amplifications become essentially the same) at a moderate level of amplification within the compressive range. In doing so, hearing impaired individuals with different hearing losses may be fitted with similar nonlinear gains at moderate to high signal levels.

Figure 6:
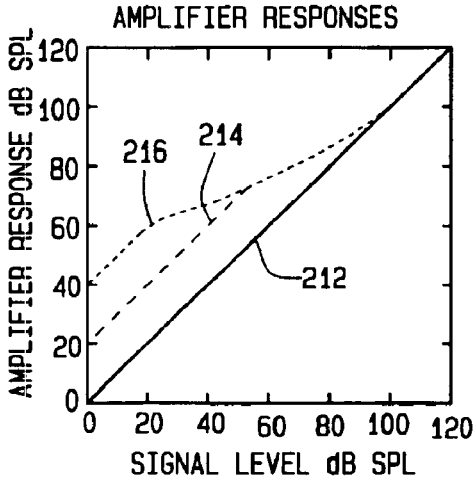
FIG. 6 is a graph showing representative members of a preferred family of amplifier responses.

Representative members of a preferred family of amplifier responses in accordance with this observation are shown in FIG. 6. Curve 212 in FIG. 6, which is shown for reference purposes only, represents the amplification gain that would be required for a healthy cochlear response (in the particular frequency band to which the curve pertains), which is unity across the entire range of signal levels, indicating that no hearing aid correction would be required. Curve 214 represents the gain required for a mildly impaired cochlear channel, while curve 216 represents the gain required for a moderately impaired cochlear channel. Thus, the merging characteristics of the amplifier responses is a preferred characteristic of a multichannel hearing aid. Each of the curves 216 and 214 have a section at low signal levels providing a constant gain, a middle region providing an instantaneously variable compressive gain, and a section at high signal levels that provides unity gain.

A striking similarity exists between the nonlinear amplifier characteristics shown in FIGS. 1 and 6. Both are merging families of compressive amplifier responses, with the compression threshold being the varied parameter among family members. But each figure represents a different aspect of the invention. Each curve in FIG. 6 corresponds to a possible quiescent transducer characteristic (solid curve) in FIG. 1. The quiescent transducer characteristic is chosen to (1) alleviate the average hearing loss in the frequency band of each channel, and (2) control recruitment. From FIG. 6, one can determine where the quiescent compression threshold should be set. The dashed curves in FIG. 1 represent the adaptive property of the nonlinear amplifier, which controls the transducer waveform compression. By adjusting the compression threshold, performance of the hearing amplification device can be tailored to its environment.

Figure 7:
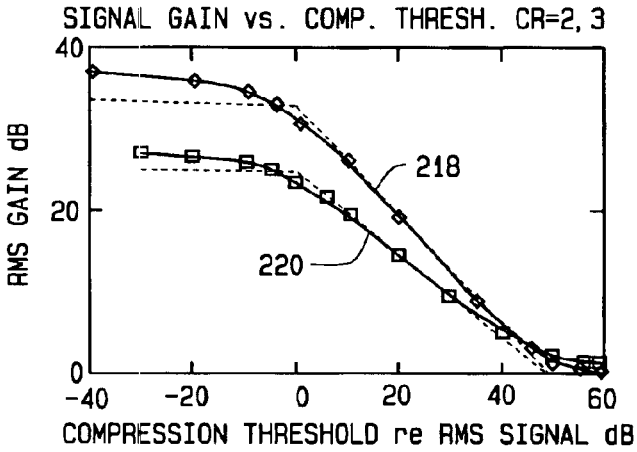
FIG. 7 is graph showing the effects of compression threshold adjustments relative to the RMS level of the received sound signal on the RMS amplifier gain.

Guidance for the design of the adaptive nonlinear amplifier is provided by a quantitative study of the physical effects on the acoustic response to speech caused by systematic shifts of the compression threshold. FIG. 7 shows the effects of placement of the compression threshold on the RMS gain of the amplifier. The Y-axis plots the RMS gain in dB while the X-axis plots the compression threshold relative to the input RMS level of the received speech signal. As noted earlier, the compression threshold is defined as the level of intersection for the asymptotes for low-level linear response and higher-level compressive response. Identical nonlinear transducer functions were used for each channel, and the compression thresholds were shifted uniformly in all channels. The RMS signal level of the speech plus noise was 50 dB below the high-level transition from compressive to linear response. For compression thresholds below the input RMS level, the gain is nearly constant. In this case, the signal level instantaneously determines the gain. On the other hand, for compression thresholds above the input RMS level, the gain is determined by the "small-signal" linear response of the transducer. This gain is controlled by the compression threshold, as shown for cube-root (CR=3) compression (curve 218) and square-root (CR=2) compression (curve 220). The dashed lines represent the results simply, and also indicate that in the absence of high-level linearization in the amplifier, the attenuation with increasing compression threshold would continue lawfully.

It was shown in FIG. 1 that rapid compressive amplification of speech in the presence of a weaker noise background produces an undesirable greater amplification of the noise relative to the speech. This degradation in the contrast between presence and absence of the speech is quantified in FIG. 8 in terms of the ratio in dB of the RMS response to speech plus noise and the RMS response to noise alone. Curve 222 is for cube root (CR=3) compression, and curve 224 is for square root (CR=2) compression. As the compression thresholds are increased relative to the input RMS level, the contrast approaches the SNR input ratio, as expected from a linear amplifier, and indicating that contrast improves as the compression threshold is upwardly adjusted, but that the improvement is capped at around 20 dB above the input RMS level.

Figure 9:
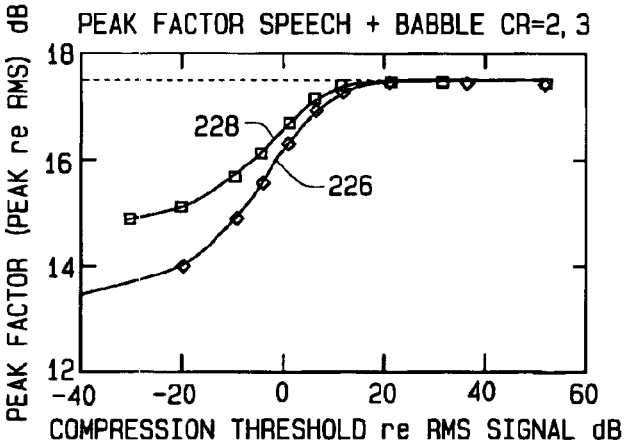
FIG. 9 is a graph showing the effects of compression threshold adjustments relative to the RMS level of the received sound signal on the peak factor of the amplifier response for speech plus babble-noise.

A direct measure of waveform compression caused by rapid compression is quantified with the Peak Factor of the response waveform. The Peak Factor is defined as the ratio in decibels of the maximum amplitude of response waveform and the RMS amplitude of speech plus noise. It is shown in FIG. 9 that with an increase in compression threshold, the effective signal processing becomes linear, and the Peak Factor approaches its maximum for a compression threshold approximately 20 dB above the input RMS level. Curve 226 is for cube root (CR=3) compression, and curve 228 is for square root (CR=2) compression.

From the physical measurements in FIGS. 7–9, a reasonable target for setting the compression threshold would be in a range of approximately 5 dB below the average sound level and about 5 dB above the average sound level, which holds the responses in the beneficial regions of FIGS. 7–9. That is, the gain, contrast, and peak factor are all at satisfactory levels in this range. In preliminary psychophysical experiments with normal hearing subjects, it was found difficult to discriminate between the settings of −3 and 5 dB for square root compression of noisy speech. If waveform compression is useful in audio amplification, then even for noisy signals, some optimum adapted compression threshold should exist.

The best setting is more uncertain when processing clean speech, as the perceived effects of compression can be minimal (with cube root compression) or inaudible (with square root compression). Thus, for clean speech the quiescent nonlinear gain characteristic would provide adequate gain control with no need for adaptation of the compression thresholds, or the compression threshold can be adjusted between the range of the quiescent compression threshold to about 20 dBs below the average sound level of the sound signal and still provide excellent results.

Figure 8:
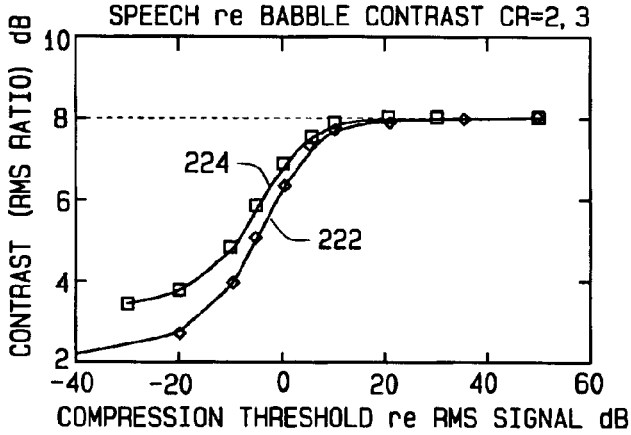
FIG. 8 is a graph showing the effects of compression threshold adjustments relative to the RMS level of the received sound signal on the contrast in the amplifier responses for speech plus babble-noise and for babble-noise alone.

It should be noted that while the effects of shifting compression thresholds shown in FIGS. 7–9 are general, the detailed calibration of the abscissa is dependent upon the division of the audio spectrum into separate bands in the amplifier design. In the six-channel amplifier that was investigated, most of the signal energy was divided among the lowest four octave bands. Therefore, to achieve similar results, a single channel wideband adaptive nonlinear amplifier would require over 6 dB greater shifts in compression threshold relative to the input signal.

The form of the quiescent transducer characteristic of the nonlinear amplifier shown in FIGS. 1 and 6 is supported by considerable psychophysical data. Studies have shown that, at high signal levels, clinically normal listeners experience accelerated growth in loudness which is consistent with the high-level decompression specified for the nonlinear hearing aid amplifier on the basis of nonlinear cochlear models. However, studies of hearing impaired individuals indicate that reduced tolerance for intense sounds is common. Therefore, in the following a means is included in the invention to evaluate the benefit of decompression for hearing aid users.

Figure 10:
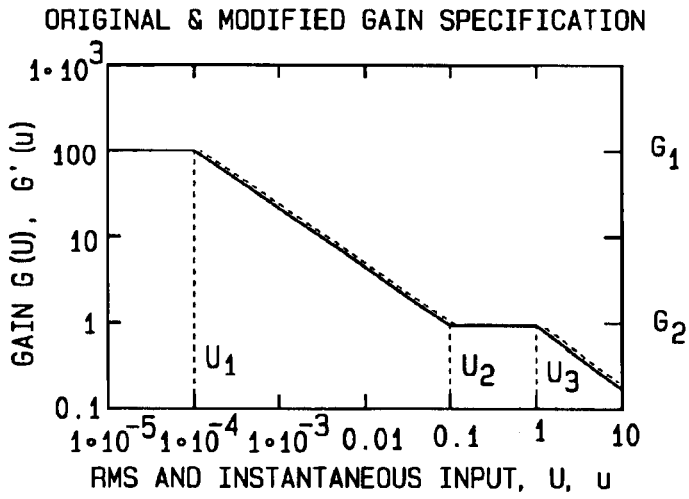
FIG. 10 is a gain specification for compressive amplification with a small modification to correct for instantaneous power-law compression.

A systematic engineering technique is next described for synthesizing the compressive transducer functions based on the foregoing. An idealized engineering specification is given in FIG. 10 for the required compressive gain. It is an idealization of FIG. 5 with the addition of protective attenuation at the highest levels. The independent variable, U, that is controlled in the signal processing design, is proportional to RMS sound pressure at the hearing aid transducer. Three linear/nonlinear transition levels are shown: a quiescent compression threshold at $U_1$ (linear-to-nonlinear), a decompression threshold at $U_2$ (nonlinear-to-linear), and a threshold for protective attenuation at $U_3$ (linear-to-nonlinear). The compressive ranges between $U_1$ and $U_2$ and above $U_3$ obey power-law compression, that is, the gain is proportional to $U^{p-1}$, where U is the RMS input signal and 1/p is the compression ratio. The compression ratios are 3 and 4 in the intermediate and upper ranges, respectively.

The gain specification is given as a function of RMS signal amplitude. This unambiguously specifies the required gain of a linear amplifier with adaptive gain control (i.e., conventional AGC). In contrast, the exact gain of an essentially nonlinear amplifier depends upon signal waveform as well as its RMS amplitude. In principle, it is incorrect to interpret the gain specification as a function of the instantaneous input to a nonlinear transducer. In practice, however, it is a reasonable approximation. A small, but not unique correction can be defined with the engineering describing-function description of a nonlinear transfer function, in which the fundamental response to a sinusoidal signal defines the system response. Using this definition, one finds that the describing-function gain for an ideal sign-preserving power-law transducer is only slightly smaller than the instantaneous gain (f(u)/u) of the transducer, when both the RMS and instantaneous inputs are numerically equal.

Figure 11:
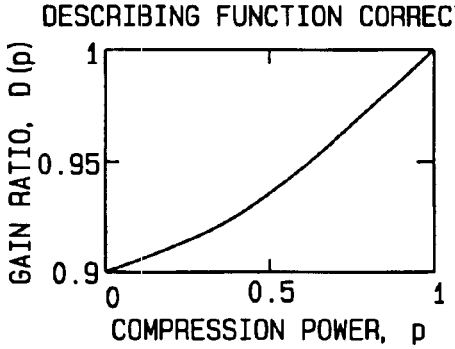
FIG. 11 is the ratio of describing-function gain to instantaneous gain for an ideal power-law transducer used to calculate the gain correction in FIG. 10.

This relationship is shown in FIG. 11, both graphically and analytically. The slightly modified gain specification G'(u) shown in FIG. 10 by the dotted lines is obtained by multiplying G(U) by the reciprocal of the describing-function factor, D(p):

$$D(p) = \left(\frac{2}{\sqrt{\Pi}}\right)\frac{\Gamma(1+0.5p)}{\Gamma(1.5+0.5p)2^{0.5(1-p)}};$$

wherein Γ( ) is the gamma function

This modification is further defined as equivalent to shifting the nonlinear thresholds to slightly higher values, as follows:

$$U_1' = U_1 D(1/3)^{-3/2},\ U_2' = U_2 D(1/3)^{-3/2},\ U_3' = U_3 D(1/4)^{-4/3}$$

The modified gain specification is next synthesized as a cascade of three asymptotic transducers, one for each threshold in the specification, which in this example covers $U_1$, $U_2$ and $U_3$, as follows:

$$TA1(u, U_1') = TA(u, 100, U_1', 1/3);$$

$$TA2(u) = TA(u, 1, U_2', 3); \text{ and}$$

$$TA3(u) = TA(u, 1, U_3', 1/4).$$

The first transducer function, TA1, provides the needed gain correction and the adaptable compression threshold $U_1$. The second transducer function, TA2, provides decompression at high signal levels. The third transducer function, TA3, provides protective attenuation at extreme signal levels. These asymptotic transducers each represent a class of transducers with different rates of transition between linear and nonlinear responses, as defined earlier.

To explicitly add the adaptive feature to the transducer TA1(u,$U_1$'), the dependence of its small signal gain on its variable compression threshold, $U_c$, is between the quiescent compression threshold, $U_1$', and the decompression threshold $U_2$'. At the low end of the range the small signal gain will equal the specified gain $G_1$=100. At the high end of the range the small signal gain will be the specified gain $G_2$=1. Within the range, the small signal gain A, is lawfully described by a power law, and an explicit formula for the adaptive transducer follows:

$$A(U_c)=(U_2'/U_c)^{1-p};\ \text{thus}\ TA1(u,U_c)=TA(u,A(U_c),U_c,p).$$

Figure 12:
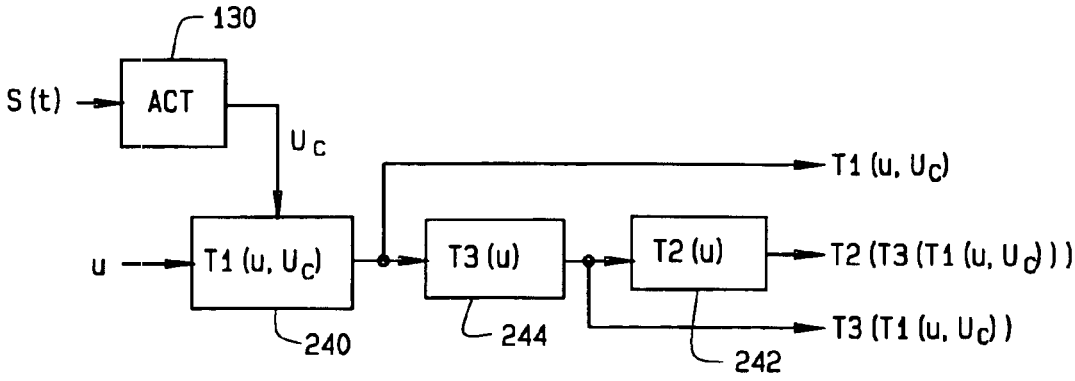
FIG. 12 is a block diagram of the preferred cascade implementation of the IWDRC transducers with basic memoryless transducers that are linear for small signals and sign-preserving power-law at large signals.
Figure 13:
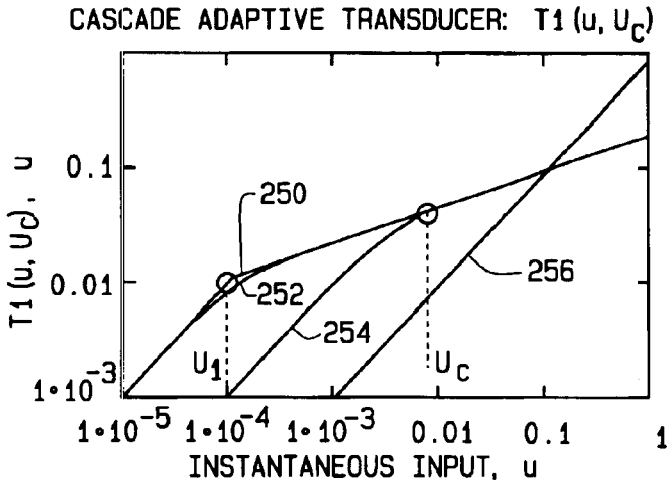
FIG. 13 is the first basic IWDRC transducer in FIG. 12, with an adaptive compression threshold and providing the specified maximum low-level linear gain correction and intermediate-level power-law compression.

FIG. 12 shows a preferred order of the cascaded transducers. In particular, the first transducer 240 provides adaptive compressive amplification. FIG. 13 depicts the gain characteristic for TA1. In FIG. 13, curve 250 depicts the asymptotic form for TA1, wherein a sharp transition is provided between linear gain and compressive gain. Curve 252 depicts the smooth form (n=2) for TA1, wherein a smooth transition is provided. Curve 256 is the identity function (unity gain), shown for reference.

It should be noted that the amplification provided by a transducer having linear gain for inputs corresponding to a sound signal having a sound level less than the compression threshold $U_1$ and compressive gain for inputs having a sound level greater than the compression threshold may be adequate for many hearing aid users. As such, the present invention need only employ the first transducer function, TA1. However, for additional features such as decompression at higher levels and attenuation at extreme levels, the second transducer 242 and the third transducer 244 are useful.

Figure 14:
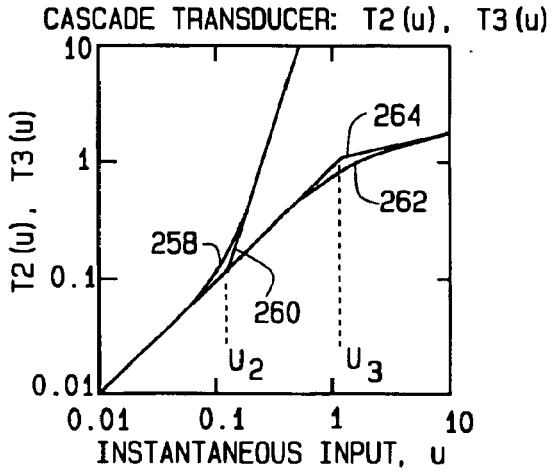
FIG. 14 shows the two nonadaptive transducers that provide decompression at high sound levels, and protective attenuation, respectively.

FIG. 14 illustrates the gain characteristics for both TA2 (curves 258 and 260) and TA3 (curves 262 and 264). Curves 258 and 260 depict unity gain for inputs corresponding to a sound signal having a sound level less than the decompression threshold $U_2'$ and expansive gain (at the inverse of TA1's compressive gain) for inputs corresponding to a sound signal having a sound level greater than the decompression threshold; curve 258 shows a smooth transition between unity response and expansive response while curve 260 shows a sharp transition (asymptotic) between unity response and expansive response. Curves 262 and 264 depict unity gain for inputs corresponding to a sound signal having a sound level less than the attenuation threshold $U_3'$, and compressive gain for inputs corresponding to a sound signal having a sound level greater than the attenuation threshold; curve 262 shows a smooth transition between unity response and compressive response while curve 264 shows a sharp transition (asymptotic) between unity response and compressive response.

Figure 15:
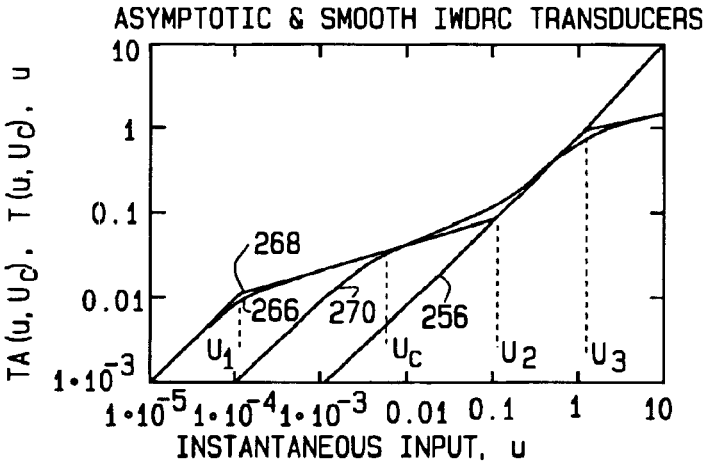
FIG. 15 is the full IWDRC transducer comprising a cascade of the three transducers in FIGS. 13 and 14.

FIG. 15 shows the gain characteristic for the full cascade of transducers, $T_{FULL}$ (shown as the output from TA2 in FIG. 12), wherein:

$$T_{FULL}=TA2(TA3(TA1(u,U_c)))$$

Curve 266 shows the gain characteristic for $T_{FULL}$ having smooth transitions. Curve 268 shows the gain characteristic for $T_{FULL}$ having sharp transitions.

It should be noted that the order of transducers in the cascade of transducers can be any order. However, it is preferable to place TA3 before TA2 to prevent the expansive region of TA2 from producing an overly large signal. In this configuration, $U_c$ is the variable which controls the location of the compression threshold. $U_c$ may take any value between $U_1'$ and $U_2'$. In FIG. 13, curve 254 illustrates the adapted gain characteristic that results from upwardly adjusting the compression threshold to $U_c$. Curve 270 in FIG. 15 illustrates how the change to TA1 affects $T_{FULL}$. As can be seen from FIG. 15, the gain characteristics of the family of cascaded transducer functions closely resembles the desired gain characteristic shown in FIG. 1.

Figure 16:
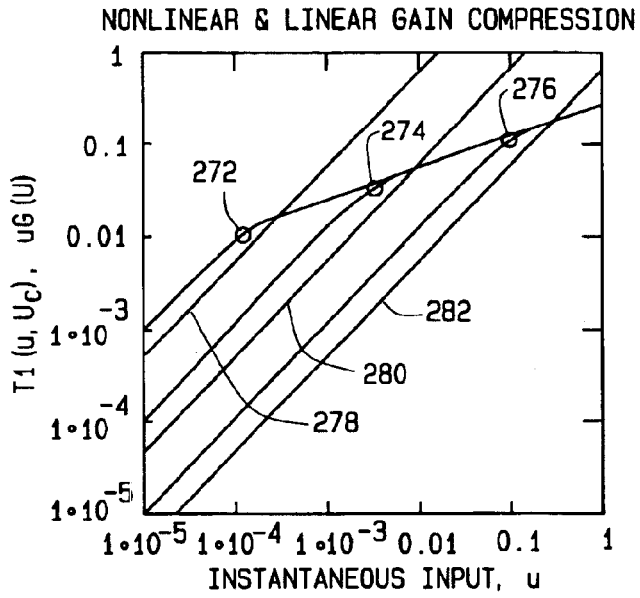
FIG. 16 is the adaptive IWDRC transducer from FIG. 13, in three different adapted states in comparison with an adaptive linear amplifier.

As previously mentioned, an important property of the adaptive nonlinear amplification is that gain compression and waveform compression are independently controlled. This improvement over conventional adaptive linear amplification is illustrated by FIG. 16 which shows three settings 272, 274, and 276 of the adaptive compression threshold for three different RMS signal amplitudes, along with the linear responses 278, 280, and 282 of an adaptive linear amplifier. The linear amplifier gain is specified by G(U) in FIG. 10. The nonlinear amplifier provides controlled waveform compression with the compression threshold set 10 dB below the RMS signal amplitude. Also, the nonlinear amplifier provides gain compression independently of the adaptive mechanism, while the linear amplifier requires an adaptive mechanism for this function. Linear amplification requires that short release times be used to provide syllabic compression. However, this creates a conflict with the need for long release times to avoid annoying amplification of background noise. This conflict illustrates the underlying problems associated with adaptive linear amplifications.

Figure 17:
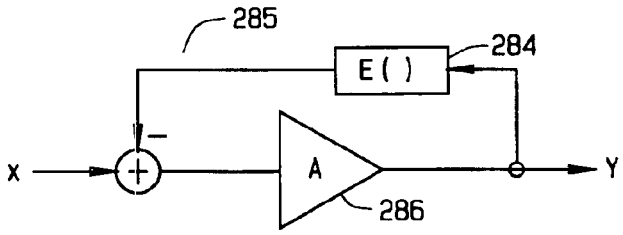
FIG. 17 is a schematic representation of an analog signal implementation of a basic compressive transducer.
Figure 18:
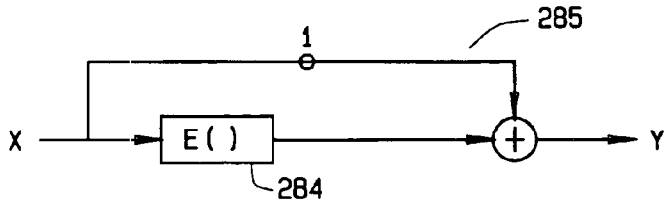
FIG. 18 is a schematic representation of an analog signal implementation of a basic expansive transducer.
Figure 19:
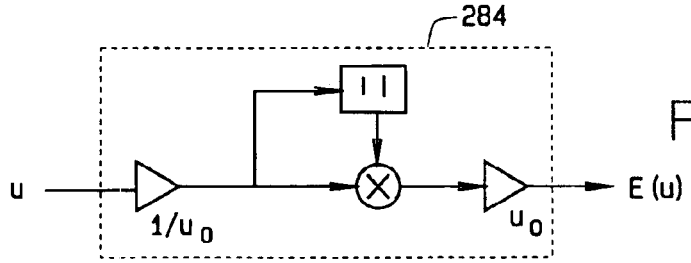
FIG. 19 is a schematic representation of an analog signal implementation of a sign-preserving ideal square-law transducer for FIGS. 17 and 18.
Figure 20:
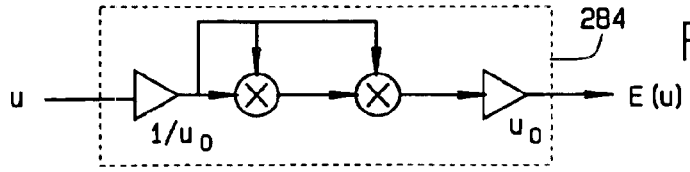
FIG. 20 is a schematic representation of an analog signal implementation of a sign-preserving ideal cube-law transducer for FIGS. 17 and 18.

A preferred analog implementation of a hearing aid in accordance with the present invention realizing the basic compressive and expansive transducers of FIGS. 13 and 14 are shown in FIGS. 17 and 18 as an analog signal processor 285 (with feedback and feedforward circuits respectively). The analog signal processors 285 of FIGS. 17 and 18 provide very smooth transition between small-signal linear and large-signal power-law responses, corresponding to a smoothness parameter, n, of 1 or 2. Box 284 provides an expansive function, $$E(u)=u_o sgn(u)|u/u_o|^m,$$

and is included in both circuits. Implementations of E(u) for m of 2 and 3 are shown in FIGS. 19 and 20, respectively.

Direct control of the small-signal gain, and the compression threshold is provided by the amplifier 286 in FIG. 17. The compression threshold is $$u_c=u_o/A^{m/(m-1)}.$$

Different values of the gain A will generate the desired merging family of transducer responses (FIG. 13). Thus, analog gain control can be used to set both the quiescent gain correction (largest gain and lowest compression threshold) and for adapting the compression threshold. Alternatively, the controls can be provided with pre- and post-compression amplifiers, as discussed earlier. The basic expansive transducer in FIG. 18 provides unity small-signal gain, and a decompression threshold at $u_0$. The value of $u_o$ can be chosen independently for each basic transducer in a cascade design.

Figure 21:
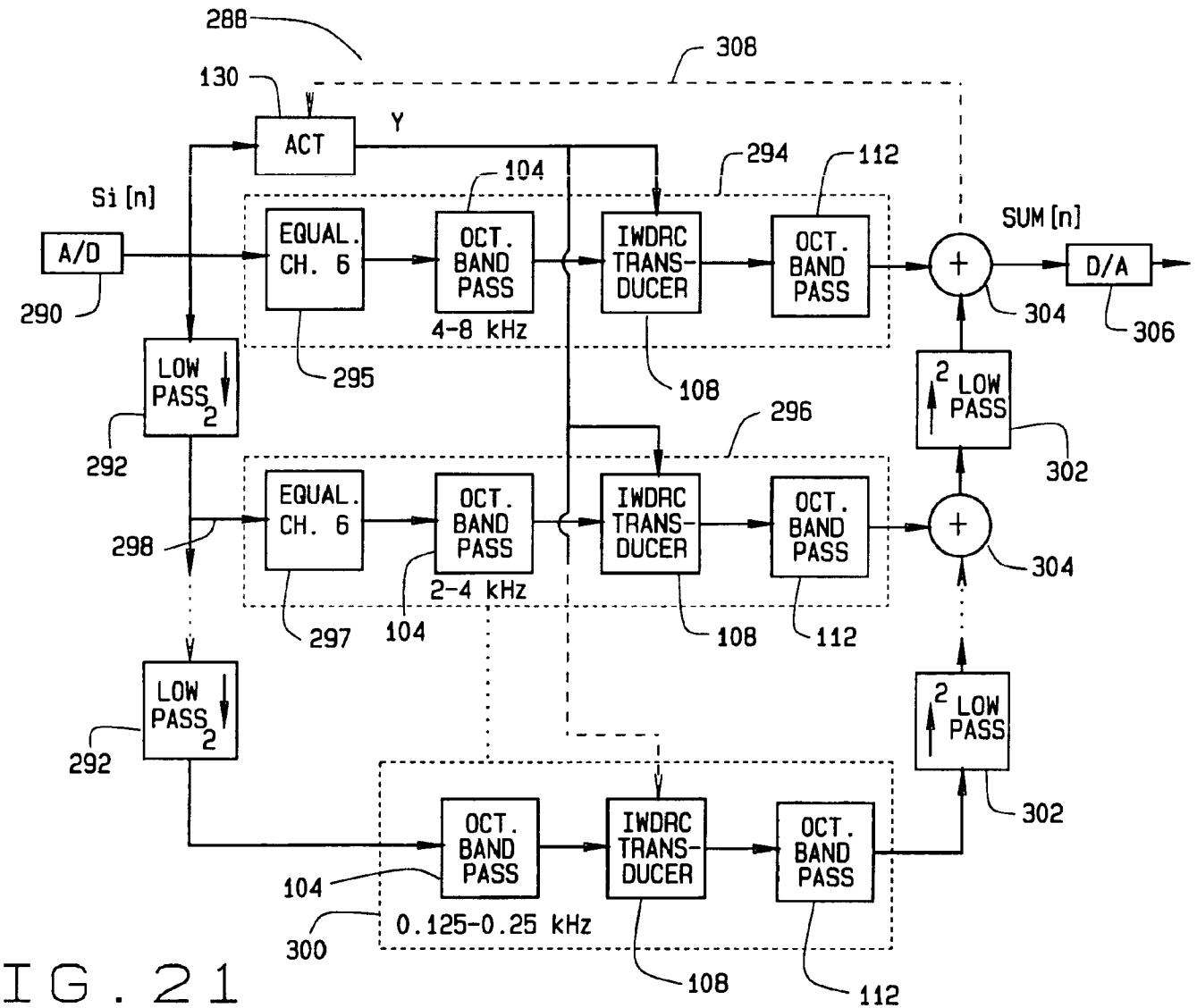
FIG. 21 is a block diagram of the preferred DSP embodiment of the hearing aid amplifier of the present invention.

A preferred digital implementation of a multichannel hearing amplification device in accordance with the present invention is shown in FIG. 21. A digital signal processor (DSP) serves as an excellent medium in which the present invention can be digitally implemented. Such a digital signal processor can be coupled to an analog-to-digital converter (ADC) which provides a digital representation of the received sound signal to the DSP and a digital-to-analog converter (DAC) which provides a speaker (not shown) with an amplified sound signal for presentation to a user.

In FIG. 21, an analog-to-digital converter 290 converts an analog signal corresponding to a sound signal to a digital signal $S_i[n]$, $S_i[n]$ being the i'th block of a much longer data stream. $S_i[n]$ is a data set having a number of samples N. Multirate digital signal processing is preferably used to reduce the data processing rate well below that required by alternative multichannel designs with uniform sampling rates. However, the present invention encompasses digital implementations with or without multirate digital signal processing.

Multirate digital signal processing is achieved by successively halving the sampling rate for each lower octave channel of the hearing amplification device with a series of low pass and decimation filters 292, in accord with basic sampling theory.

The input data set, $S_i[n]$, provided to the DSP 288 is the full audio signal sampled at the highest rate. This full audio signal is processed directly in the highest frequency channel (4–8 kHz is the preferred range) shown as the topmost channel 294 in FIG. 21. BPF 104 of channel 294 is tuned with a passband matching the audio frequency range of channel 294. $S_i[n]$ is filtered through BPF 104, and then the filtered signal is processed by IWDRC transducer 108 which is configured with the gain characteristic and adaptable compression threshold of the present invention. Thereafter, the output from transducer 108 is filtered by post-filter 112 as described above in connection with FIG. 1.

The data set provided to the next lower channel 296 (2–4 kHz being the preferred range) is obtained by passing $S_i[n]$ through filter 292 which eliminates the frequencies in the highest range (the frequency range of channel 294) by means of lowpass digital filtering, and then downsamples the filtered data set by eliminating every second sample. Downsampled signal 298 is processed by the nonlinear transducer 108 of channel 296, with pre- and post-bandpass filtering (BPFs 104 and 112). Then, the signal leaving channel 296 is upsampled to the original sampling rate by lowpass and interpolation filter 302 and added to the output of the other channels. The upsampling is accomplished by inserting a zero amplitude sample after every second sample in the output of the second filter of the channel, and then interpolating the inserted sample amplitudes using lowpass filtering with amplitude scaling of 2. This scheme is repeated successively for each lower octave channel. The outputs of each channel are summed through the interpolation filters 302 and adders 304 to generate the resultant amplified sound signal Sum[n] provided to DAC 306.

In addition to the savings in data processing, the multirate design allows use of identical bandpass and lowpass filters in all channels. Many conventional techniques are available for filter design. A preferred design uses 21 tap FIR bandpass filters (with cutoff frequencies $\pi/4$ and $\pi/2$, and 22 tap lowpass filters (with cutoff frequency $0.30\pi$), each synthesized as a windowed Butterworth IIR filter. The equalization stages 298 shown in FIG. 21 for the upper channels (all but the lowest frequency channel 300) are delays added to provide equal average group delay for the signals processed in each channel. Thus, a broadband audio signal with a well defined temporal epoch will be compactly reconstructed in a similar, but delayed, time window in the multichannel output Sum[n]. In an alternative design with a single channel broadband compressive audio amplifier, a linear phase filter design is preferred.

In the preferred digital implementation, the transducers 108 are represented as a stored program that computes the transducer algorithms described earlier. The simplest algorithm found satisfactory to the user (in clinical tests) should be used, which necessarily includes the basic compressive transducer with a controllable compression threshold ($U_c$).

The compression threshold controller 130 of the present invention is designed to provide "intelligent control" of the compression threshold for the transducer in each channel of the multichannel amplifier. "Intelligent control" refers to two aspects of the design: (1) adaptation in response to a user input, and (2) adaptation in response to changes in the received sound signal (signal knowledge). It is presumed that similar functions exist in the normal cochlea through efferent feedback from the brainstem, which is degraded or absent in the impaired cochlea.

The basic controller design monitors the input signal $S_i[n]$ to implement feedforward control as indicated in FIG. 1. A feedback input to the controller, shown as dashed line 308 in FIG. 21, represents an alternative implementation that monitors both input and output for more intelligent use of signal knowledge, as will be described in conjunction with FIG. 22. However, the feedback input is an optional feature. In a simpler embodiment, the controller 130 monitors the digital representation $S_i[n]$ of the received sound signal to estimate an RMS level for the sound signal and then adjusts the compression threshold accordingly.

Preferably, the present invention provides intelligent control through three operating modes available to the user. These three operating modes include: (1) adaptive compression threshold (ACT) "off", 2) ACT "on" under processor control, 3) ACT temporarily "locked" by the user to an adapted operating state above quiescent. The controller should be switchable between those three operating modes, either in response to a user input, or automatically in response to processing of the input signal $S_i[n]$ or output signal Sum[n] to determine which mode is appropriate.

Under the first operating mode ("off"), the controller 130 maintains the compression threshold at its quiescent level (essentially, the controller either does not adjust the compression threshold, or sets the compression threshold back to its quiescent level). The first operating mode is useful when listing in a search mode for a desired sound signal in the acoustic environment.

Under the second operating mode ("on"), the controller 130 adjusts the compression threshold in response to changes in the sound signal, preferably as shown in the flowchart of FIG. 22. The second mode is generally useful when initiating different conversations in a noisy environment.

Under the third operating mode ("locked"), the controller locks the compression threshold at its current level. The third mode is useful when the conditions of a conversation are fixed, and no interest exists in the ambient acoustic environment, or when the user has found that the current compression threshold provides comfortable results.

In FIG. 21 it is shown that the same control signal Y is sent to each channel by the controller 130. This control signal Y is constant for the "off" and "locked" modes, and time varying for the "on" mode. The generation and application of the control signal are described in FIGS. 22 and 23, respectively.

The preferred algorithm for the second operating mode (the "on" mode) is shown in FIG. 22, in the form of a program flowchart. The goal of this design is to estimate the RMS level of a speech signal and to provide a control signal to the transducers relatively quickly that is proportional to the average sound level of the speech signal. It is preferred that the control signal be relatively steady in response to temporarily minor fluctuations in speech in order to prevent a "knee jerk" reaction to normal fluctuations in speech, wherein brief pauses in conversations result in overamplification of background noise because the compression threshold has been prematurely reduced.

Therefore, it is desirable that the compression threshold not be reduced until the signal's average sound level drops by a triggering amount, which identifies when a need exists to drop the compression threshold to adapt to a quieter environment. However, it is also desirable that the compression threshold quickly track increases in the sound signal's average sound level to minimize overamplification of background noise. The flowchart describes how these goals are accomplished.

At step 1000, two variables X (the signal indicator) and I (the release time counter) are initialized to zero. Next, at step 1002, the controller receives signal block $S_i[n]$ which is an N bit long (n=1:N) digital representation of a portion of the sound signal. The value of N may be different for different signal blocks. "X" represents the present estimate of the maximum amplitude of the signal block $S_i$, and "I" represents a count of the number of signal blocks processed by the controller since a determination has been made that a decrease in signal peak is significant.

At step 1004, controller determines the peak (maximum magnitude) $X_i$ of signal block $S_i[n]$. $X_i$ will be the sample of $S_i[n]$ having the largest amplitude. Next, at step 1006, the controller will sort $X_i$ with respect to the currently stored value of X. Essentially, the controller will determine (1) whether the peak is increasing from the stored peak (is $X_i>X$?), (2) whether the peak is decreasing an insignificant amount (is $\rho X<X_i\leqq X$?, and (3) whether the peak is decreasing a significant amount, that is, decreasing by a triggering amount (is $X_i\leqq\rho X$?). The parameter ρ is used to control the triggering amount. Preferably, $0<\rho<1$, and more preferably ρ is set equal to ½.

After determining at step 1006 how strongly the peak of $S_i[n]$ has fluctuated from the peak confirmed for $S_{i-1}[n]$, the controller proceeds to either step 1008, 1010 or 1012 depending upon the sorting result. Step 1008 is reached when $S_i$ is greater than X. At step 1008, X is set equal to $X_i$ so that the stored peak value immediately tracks increases in peak (allowing the compression threshold to quickly track increases in sound level). Also, I is reset to zero; the role of I will be more fully explained below.

Step 1012 is reached when step 1006 results in a determination that while the peak of the sound signal may be decreasing, it is decreasing by an insignificant amount which does not require an adjustment of the compression threshold. As such, at step 1012, the current value of X is retained ($X_i$ is ignored), and I is set to zero.

Step 1010 is reached when step 1006 results in a determination that $X_i$ has decreased from X beyond a triggering amount (set by the value for ρ), thereby indicating that a decrease in the compression threshold may be needed. However, to avoid a situation where the compression threshold is prematurely decreased (which may cause an undesired overamplification of background noise, such as may occur with a brief pause in a normal conversation during which the peak value of the signal will briefly decrease before increasing again), the controller implements a compression threshold release time using the variable M. M represents the release time for compression threshold reductions. Preferably, the value for M is chosen such that it equals the floor (integer dividend) of the expected duration of pauses in speech divided by the duration of each block. A two-second pause is a good indicator for expected pauses, and preferably M is set to correspond to a two-second pause. When $X_i$ continuously decreases by the triggering amount for successive signal blocks for the duration of the release time, the compression threshold will be reduced.

To implement this plan, the release time counter I is incremented at step 1010. Then, if the release time counter I has reached the release time M, then at step 1014, X is reduced to σX, wherein $\sigma<1$ (preferably $\sigma=0.7$). Also, the release time counter is reset to zero. If step 1010 determines that the release time counter I is less than the release time M, then at step 1016, the current value for X is retained, and the current value for I is retained (the controller will wait for subsequent signal blocks to determine whether a compression threshold reduction is needed).

Step 1018 is reached from steps 1008, 1012, 1014, and 1016. At step 1018, the control signal Y that is supplied to the transducers of each channel is set according to the formula Y=X/K. K is a correlation factor for the relationship between peak value and RMS value. That is, the RMS value of the signal can be estimated by dividing the signal peak by K. Experimentation has resulted in a determination that K=7 (15 dB) is a preferable peak/RMS correlation factor.

Thus, from steps 1012 and 1016, the estimated RMS value of the sound signal will not change because X was retained at its current value (control signal Y will remain the same). From step 1008, the estimated RMS value of the sound signal will be increased because X was increased to $X_i$ at step 1008 (control signal Y will increase). From step 1014, the estimated RMS value of the sound signal will decrease because X was decreased at step 1014 (control signal Y will decrease).

From step 1018, the controller returns to step 1002 where the next signal block $S_{i+1}[n]$ is processed (at step 1020, the value for i is incremented).

The control signal Y is presented to each channel, and each channel will independently adjust its compression threshold in response to Y. The action taken at each channel is constrained by its quiescent compression threshold, $U_1$, and its decompression threshold, $U_2$. While it is preferable that $U_2$ be the same for each channel, each channel may have a different $U_1$.

FIG. 23 depicts a flowchart identifying how each channel preferably adjusts its compression threshold in response to Y. It will be evident that the control strategy in FIGS. 22 and 23 shifts the compression thresholds to target effectively linear transducer processing of conversational speech with sustained sound pressure levels. From FIG. 1 it is evident that this is an adequate strategy for clean as well as noisy speech. Little is known of the potential benefits of waveform compression with respect to increasing the audibility of weak syllables in clean speech, as illustrated in FIG. 1.

As shown in FIG. 23, at step 1022, the control signal Y is received by the channel. At step 1024, Y is sorted relative to $U_1$ (quiescent compression threshold) and $U_2$ (decompression threshold). The range of $U_1$ to $U_2$ represents the permissible range between which the compression threshold may be adjusted. If Y is less than or equal to $U_1$ (indicating that the estimated RMS value of the sound signal is below the quiescent (minimum) compression threshold), then the adjusted compression threshold $U_c$ is limited to its minimum value of $U_1$ (step 1026). If Y is greater than or equal to $U_2$ (indicating that the estimated RMS value of the sound signal is above the maximum compression threshold), then the adjusted compression threshold is limited to its maximum value of $U_2$ (step 1028). If Y is between $U_1$ and $U_2$ ($U_1<Y<U_2$), then the adjusted compression threshold is set equal to Y (step 1030), thereby allowing the compression threshold $U_c$ to closely track the estimated RMS level of the sound signal as desired from an investigation of FIGS. 1, 7, 8, and 9.

The present invention is capable of adjusting the compression threshold in response to changes in the sound signal other than changes in estimated RMS value. For example, a more complex controller strategy involving the feedback suggested in FIG. 21 provides an alternative strategy for the study of controlled waveform compression. The alternative strategy would be based on the knowledge of properties of compressed speech in steady babble noise, as shown in FIGS. 8 and 9. Both peak and RMS amplitudes would be measured at the input and summed output of the DSP.

Babble and conversational speech from a single speaker are readily distinguished at the input from estimates of peak factor (see FIG. 9). This enables measurements of the contrast at the input and output. The setting of the compression threshold will determine the degree of contrast loss. Adaptive control of the correlation factor K in FIG. 22 can target a desired loss of contrast due to waveform compression. For example, little or no audible benefit exists for contrasts greater than 30 dB. Hence, inputs with contrasts exceeding 30 dB can be compressed to provide output contrasts no less than 30 dB. Input contrasts less than 30 dB can be compressed with little or no audible effect if the contrast is decreased by no more than 1 dB.

It will thus be seen that the inventive hearing aids described herein provide qualities of signal amplification heretofore unknown to the art. A maximum sensitivity to weak signals is provided, while instantaneous gain compression protects the inner ear from uncomfortable sudden intense sounds, which can occur too rapidly for effective gain compression with conventional AGC. Furthermore, disturbing overamplification of unwanted background sound is avoided by adaptive control of waveform compression in accordance with the invention.

Moreover, systematic audiological testing is made possible by providing a hearing aid in conjunction with a diagnostic device, wherein both are derived from advanced audiological models. Such models reduce to a minimum the adjustments that may be required for hearing aid fitting, including the setting of gain for a single gain element in each frequency channel, while essentially eliminating the need for manual gain control. Thus, it will be seen that the various objects of the invention are achieved and other advantageous results are obtained.

The devices of the present invention may be used for diagnostic purposes, and for determining parameters of hearing aids to be fitted on individuals with impaired hearing. For example, the device of FIG. 21 may be used as follows: First, an audiogram of a patient with impaired hearing is obtained by standard means and compared with a standard audiogram. Next, the patient's maximum comfortable level for intense sounds is determined. The difference between the maximum comfortable level of the patient (in various frequency bands) and the patient's audiogram is the maximum impaired dynamic range. The difference between the maximum comfortable level of the patient for intense sounds and the normal audiogram is the normal dynamic range. The ratio of the normal dynamic range to that of the impaired dynamic range is the amount of compression that is required.

Once the required amount of compression is determined, a choice of $G_1$ (the amount of low level gain needed at low signal levels) and p (the compression power) is made, based upon and in accordance with the models used in this invention, to produce the required compression. $G_1$ can be directly determined by the measured loss of sensitivity, while p can be selected from the values ½, ⅓, and ¼, subject to further testing for patient preference. The instrument of FIG. 21, which would be provided with controls or a keyboard to input the required frequency bands and the values of $G_1$ and p for each frequency band for simulation purposes, is then adjusted to produce the required amount of compression determined in the above steps.

It is preferred to choose a common compression ratio (1/p) for all of the channels, so that the quiescent transducer responses for the different channels merge at high signal levels, while differing at low levels only in the compression threshold determined by $G_1$. The smallest compression ratio should be chosen from among the values 2, 3 and 4, to provide the range compression needed for signal frequencies of 0.5, 1.0 and 2.0 kHz. These frequencies are found to be most important for speech communication. Greater hearing losses at other frequencies should be corrected only to the extent possible with the chosen compression ratio. Compensation should be included for the loss of normal free-field acoustic amplification by the outer ear caused by use of standard earmolds or insert earphones. A preferred compensation provides a constant 14 dB gain emphasis for the 2–4 kHz channel relative to the other channels.

An audio test is then performed with signals being presented at the input of the device, which are amplified in accordance with the parameters that are provided, with the resulting audio output being provided to the patient. If the patient communicates that he/she has perceived the results as being satisfactory, a hearing aid may be provided to the patient in accordance with the gain, compression threshold, and compression power determined. Otherwise, the values of $G_1$ and p can be adjusted until empirically satisfactory results are obtained. Once $G_1$ and p are determined, these can be used in the hearing aid amplifier design in accordance with either the analog or digital implementations described herein, or their equivalents. Preferably, one or both of these parameters may be externally adjustable for each in fitting and for accommodating future hearing impairment changes, if necessary. The nature of the adjustments for the inventive hearing aid are particularly suited for compensating such changes, because of their basis in the cochlear models.

It will be noted that the inventive devices described herein may be advantageously employed as a research tool to explore various forms of patient hearing loss and appropriate corrective parameters Inasmuch as various changes and modifications to the embodiments described above may be made without departing from the scope of the invention, it is intended that the description and drawings be considered as illustrative rather than limiting.

For example, the present invention may also be implemented in a hearing amplification device wherein the compression threshold controller switches between two or more predetermined compression thresholds in response to either signal knowledge or user input to adapt the device to various types of environments (noisy, quiet, etc.). For example, a first compression threshold can be set for optimal results in a quiet environment and a second compression threshold can be set for optimal results in an expected noisy environment, and the controller can be configured to allow switching between those two compression thresholds depending to its environment.

Also, as briefly mentioned above, the adaptable compression threshold control can be manual (adjustable in response to a user input) rather than automatic. Such a feature would allow a user to tune the hearing amplification device to a setting that is chosen as appropriate by the hearing amplification device user.

It will also be apparent that one may realize certain of the objects of the invention without realizing all of them in various less preferred embodiments that fit within the scope and spirit of the invention, but which may not necessarily be presented as example embodiments herein. Therefore, the scope of the invention should be determined by reference to the claims appended below in view of the disclosure, including any legal equivalents thereto.

What is claimed is:

1. In a hearing amplification device adapted to receive a sound signal, the hearing amplification device having at least one bandpass non-linearity (BPNL) channel configured to receive an input representative of said sound signal, the improvement comprising:

said channel being further configured with a memoryless nonlinear amplifier to provide (1) linear gain for an input representative of a portion of a subband of said sound signal having an instantaneous sound level less than a compression threshold, (2) instantaneous compressive gain for an input representative of a portion of a subband of said sound signal having an instantaneous sound level greater than said compression threshold, wherein said instantaneous compressive gain is less than said linear gain, and (3) control of said compression threshold that is adaptive at least partially in response to changes in said sound signal, and wherein said at least one channel is configured to have its compression threshold initially set to a predetermined quiescent level, and wherein said at least one channel is further configured to adjust said compression threshold such that said compression threshold is in a range of about said predetermined quiescent level to about 20 decibels below an average sound level of at least a portion of said sound signal.

2. The hearing amplification device of claim 1 wherein said at least one channel is further configured to provide a smooth transition between said linear gain and said instantaneous compressive gain.

3. The hearing amplification device of claim 1 wherein said at least one channel is further configured to provide a sharp transition between said linear gain and said instantaneous compressive gain.

4. The hearing amplification device of claim 1 wherein said at least one channel is further configured to provide (1) decompression for an input representative of a portion of a subband of said sound signal having an instantaneous sound level greater than a decompression threshold, said decompression threshold being greater than said compression threshold.

5. The hearing amplification device of claim 4 wherein said at least one channel is configured to have its compression threshold initially set to a predetermined quiescent level, and wherein said at least one channel is further configured to adjust said compression threshold such that said compression threshold is in a range of about said predetermined quiescent level to about said decompression threshold.

6. The hearing amplification device of claim 4 wherein said at least one channel is further configured to provide attenuation for an input representative of a portion of a subband of said sound signal having an instantaneous sound level greater than an attenuation threshold, said attenuation threshold being greater than said decompression threshold.

7. The hearing amplification device of claim 1 wherein said at least one channel is further configured to provide said instantaneous compressive gain as at least square root compression.

8. The hearing amplification device of claim 1 wherein said at least one channel is further configured to adjust said compression threshold at least partially in response to a user input.

9. The hearing amplification device of claim 1 having a plurality of said channels, each of said channels being responsive to an input representative of an audio frequency range different from other channels.

10. The hearing amplification device of claim 9 wherein each channel is configured to have its compression threshold initially set independently of each other channel, and wherein each channel is further configured to adjust its compression threshold at least partially in response to changes in said sound signal.

11. The hearing amplification device of claim 10 wherein each channel is configured to independently adjust its compression threshold at least partially in response to changes in said sound signal.

12. The hearing amplification device of claim 10 wherein each channel is further configured to provide (1) decompression for an input representative of a portion of a subband of said sound signal having an instantaneous sound level greater than a decompression threshold, said decompression threshold being greater than said compression threshold.

13. In a hearing amplification device adapted to receive a sound signal, the hearing amplification device having at least one bandpass non-linearity (BPNL) channel configured to receive an input representative of said sound signal, the improvement comprising:

said channel being further configured with a memoryless nonlinear amplifier to provide (1) linear gain for an input representative of a portion of a subband of said sound signal having an instantaneous sound level less than a compression threshold, (2) instantaneous compressive gain for an input representative of a portion of a subband of said sound signal having an instantaneous sound level greater than said compression threshold, wherein said instantaneous compressive gain is less than said linear gain, and (3) control of said compression threshold that is adaptive at least partially in response to changes in said sound signal, and wherein said at least one channel is configured to adjust said compression threshold such that said compression threshold is within a range of about 5 decibels below an average sound level of at least a portion of said sound signal to about 5 decibels above said average sound level.

14. In a hearing amplification device adapted to receive a sound signal, the hearing amplification device having at least one bandpass non-linearity (BPNL) channel configured to receive an input representative of said sound signal, the improvement comprising:

a plurality of channels, each of said channels being responsive to an input representative of an audio frequency range different from other channels, each channel being further configured with a memoryless nonlinear amplifier to provide (1) linear gain for an input representative of a portion of a subband of said sound signal having an instantaneous sound level less than a compression threshold, (2) instantaneous compressive gain for an input representative of a portion of a subband of said sound signal having an instantaneous sound level greater than said compression threshold, wherein said instantaneous compressive gain is less than said linear gain, and (3) adaptive control of said compression threshold;

wherein each channel is further configured to have its compression threshold initially set independently of each other channel;

wherein each channel is further configured to adjust its compression threshold at least partially in response to changes in said sound signal;

wherein each channel is further configured to provide (1) decompression for an input representative of a portion of a subband of said sound signal having an instantaneous sound level greater than a decompression threshold, said decompression threshold being greater than said compression threshold; and wherein each channel is further configured to (1) have its compression threshold initially set to a predetermined quiescent level, and (2) adjust its compression threshold such that its compression threshold is in a range of about its predetermined quiescent level to about said decompression threshold.

15. The hearing amplification device of claim 14 wherein each channel is further configured to adjust its compression threshold such that its compression threshold is in a range of about said predetermined quiescent level to about 20 decibels below an average sound level of at least a portion of said sound signal.

16. The hearing amplification device of claim 14 wherein each channel is configured to adjust its compression threshold such that its compression threshold is within a range of about 5 decibels below an average sound level of at least a portion of said sound signal to about 5 decibels above said average sound level.

17. A method of compensating for impaired hearing, said method comprising:

linearly amplifying an input corresponding to a portion of a subband of a sound signal having an instantaneous sound level less than a compression threshold;

instantaneously compressively amplifying an input corresponding to a portion of a subband of a sound signal having an instantaneous sound level greater than said compression threshold;

initially setting said compression threshold at a predetermined quiescent level;

storing a previously determined peak value for a previous portion of said sound signal;

determining a current peak value for a current portion of said sound signal; and adaptively controlling said compression threshold at least partially in response to changes in said sound signal; and wherein said adaptively controlling step includes increasing said compression threshold when said determined current peak value is greater than said stored peak value.

18. The method of claim 17 wherein said adaptively controlling step includes:

maintaining said compression threshold at its current level when said determined current peak value does not deviate by more than a predetermined triggering amount from said stored peak value; and decreasing said compression threshold when said determined current peak value deviates by more than said predetermined triggering amount from said stored peak value.

19. The method of claim 18 wherein said decreasing step includes:

decreasing said compression threshold when said determined current peak value has continuously deviated by more than said predetermined triggering amount from said stored peak value for a predetermined amount of time.

20. The method of claim 19 wherein said adaptively controlling step further includes:

setting a maximum value for said compression threshold;

setting a minimum value for said compression threshold;

estimating an average sound level for at least a portion of said sound signal from said determined current peak value;

wherein said increasing step includes increasing said compression threshold to substantially match said estimated average sound level when said estimated average sound level is less than or equal to said maximum value and increasing said compression threshold to equal said maximum value when said estimated average sound level is greater than said maximum value; and wherein said decreasing step includes decreasing said compression threshold by a fixed amount when said compression threshold minus said fixed amount would not be less than said minimum value and decreasing said compression threshold to equal said minimum value when said compression threshold minus said fixed amount would be less than said minimum value.

21. The method of claim 20 further comprising:

providing decompression for an input corresponding to a portion of a subband of a sound signal having an instantaneous sound level greater than said decompression threshold, wherein said decompression threshold is greater than said compression threshold.

22. The method of claim 21 wherein said step of setting said maximum value includes setting said maximum value as said decompression threshold, and wherein said step of setting said minimum value includes setting said minimum value as said predetermined quiescent level.

23. The method of claim 17 further comprising:

providing decompression for an input corresponding to a portion of a subband of a sound signal having an instantaneous sound level greater than said decompression threshold, wherein said decompression threshold is greater than said compression threshold.

24. The method of claim 23 further comprising:

attenuating an input corresponding to a portion of a subband of a sound signal having an instantaneous sound level greater than an attenuation threshold, wherein said attenuation threshold is greater than said decompression threshold.

25. The method of claim 17 further comprising:

performing each of said steps for a plurality of different audio frequency ranges.

26. A bandpass non-linearity (BPNL) hearing amplification device adapted to receive and amplify a sound signal, said device comprising:

a memoryless transducer for processing a transducer input according to a transfer function to thereby produce a transducer output, said transducer input being representative of a subband of a sound signal, said transducer output being representative of an amplified sound signal, said transfer function being configured to provide (1) linear gain for a transducer input representative of a portion of a subband of said sound signal having an instantaneous sound level less than a compression threshold, and (2) instantaneous compressive gain for a transducer input representative of a portion of a subband of said sound signal having an instantaneous sound level greater than said compression threshold, wherein said instantaneous compressive gain is less than said linear gain, wherein said compression threshold is initially set to a predetermined quiescent level; and a compression threshold controller coupled to said transducer for adjusting said compression threshold at least partially in response to changes in said sound signal, and wherein said controller is configured to:

estimate an average sound level for at least a portion in time of said sound signal; and adjust said compression threshold in a range of about said predetermined quiescent level to about 20 decibels below said estimated average sound level.

27. The device of claim 26 wherein said transfer function is configured to obey odd symmetry.

28. The device of claim 26 wherein said transfer function is further configured to provide a smooth transition between said linear gain and said instantaneous compressive gain.

29. The device of claim 26 wherein said transfer function is further configured to provide a sharp transition between said linear gain and said instantaneous compressive gain.

30. The device of claim 26 wherein said transfer function is further configured to provide decompression for a transducer input representative of a portion of a subband of said sound signal having an instantaneous sound level greater than a decompression threshold, wherein said decompression threshold is greater then said compression threshold.

31. The device of claim 30 wherein said transfer function is further configured to provide attenuation for a transducer input representative of a portion of a subband of said sound signal having an instantaneous sound level greater than an attenuation threshold, wherein said attenuation threshold is greater than said decompression threshold.

32. The device of claim 26 further comprising a plurality of said transducers and a plurality of channels, each channel being responsive to a different predetermined channel frequency range and comprising one of said transducers, and wherein said controller is coupled to each of said transducers, wherein said transducer input for each transducer is representative of those frequency components of said sound signal that are within its corresponding predetermined channel frequency range.

33. The device of claim 32 wherein each of said channels and said controller are implemented in a digital signal processor, each transducer input being a digital representation of said subband sound signal.

34. The device of claim 33 wherein said digital signal processor is a multirate digital signal processor.

35. The device of claim 32 wherein each of said channels and said controller are implemented in a plurality of analog components.

36. The device of claim 26 wherein said transducer and said controller are implemented in a digital signal processor, said transducer input being a digital representation of said subband sound signal.

37. The device of claim 36 wherein said digital signal processor is a multirate digital signal processor.

38. The device of claim 26 wherein said transducer and said controller are implemented in a plurality of analog components.

39. A bandpass non-linearity (BPNL) hearing amplification device adapted to receive and amplify a sound signal, said device comprising:

a memoryless transducer for processing a transducer input according to a transfer function to thereby produce a transducer output, said transducer input being representative of a subband of a sound signal, said transducer output being representative of an amplified sound signal, said transfer function being configured to provide (1) linear gain for a transducer input representative of a portion of a subband of said sound signal having an instantaneous sound level less than a compression threshold, and (2) instantaneous compressive gain for a transducer input representative of a portion of a subband of said sound signal having an instantaneous sound level greater than said compression threshold, wherein said instantaneous compressive gain is less than said linear gain; and a compression threshold controller coupled to said transducer for adjusting said compression threshold at least partially in response to changes in said sound signal, and wherein said controller is configured to:

estimate an average sound level for at least a portion in time of said sound signal; and adjust said compression threshold in a range of about 5 decibels below said estimated average sound level to about 5 decibels above said estimated average sound level.

40. A bandpass non-linearity (BPNL) hearing amplification device adapted to receive and amplify a sound signal, said device comprising:

a memoryless transducer for processing a transducer input according to a transfer function to thereby produce a transducer output, said transducer input being representative of a subband of a sound signal, said transducer output being representative of an amplified sound signal, said transfer function being configured to provide (1) linear gain for a transducer input representative of a portion of a subband of said sound signal having an instantaneous sound level less than a compression threshold, and (2) instantaneous compressive gain for a transducer input representative of a portion of a subband of said sound signal having an instantaneous sound level greater than said compression threshold, wherein said instantaneous compressive gain is less than said linear gain; and a compression threshold controller coupled to said transducer for adjusting said compression threshold at least partially in response to changes in said sound signal; and wherein an asymptotic representation of said transfer function TA1 is defined by the general formula:

$$TA=TA(u,A,U,p),$$

wherein for $|u|<U$:

$$TA(u,A,U,p)=Au$$

wherein for $|u|>U$ $$TA(u,\ A,\ U,\ p) = \mathrm{sgn}(u)AU\left|\frac{u}{U}\right|^{p}$$

wherein:

$$TA1=TA1(u,U_c)=TA(u,A(U_c),U_c(Y),p);$$

wherein $U_c(Y)=U_1$ for Y less than $U_1$ and $U_c(Y)=Y$ for Y greater than or equal to $U_1$, wherein $U_1$ represents a quiescent level for said compression threshold, wherein $U_c$ represents an adjusted compression threshold, wherein Y represents a control signal from said controller for controlling said compression threshold, wherein u represents said transducer input, wherein p represents a compression power, and wherein A represents a magnitude of gain, wherein for Y less than $U_1$:

$$A=G_1$$

and wherein for Y greater than or equal to $U_1$:

$$A = G_1\left|\frac{U_1}{U_C}\right|^{1-p}$$

wherein $G_1$ represents the magnitude of said linear gain.

41. A bandpass non-linearity (BPNL) hearing amplification device adapted to receive and amplify a sound signal, said device comprising:

a memoryless transducer for processing a transducer input according to a transfer function to thereby produce a transducer output, said transducer input being representative of a subband of a sound signal, said transducer output being representative of an amplified sound signal, said transfer function being configured to provide (1) linear gain for a transducer input representative of a portion of a subband of said sound signal having an instantaneous sound level less than a compression threshold, and (2) instantaneous compressive gain for a transducer input representative of a portion of a subband of said sound signal having an instantaneous sound level greater than said compression threshold, wherein said instantaneous compressive gain is less than said linear gain; and a compression threshold controller coupled to said transducer for adjusting said compression threshold at least partially in response to changes in said sound signal;

wherein said transfer function is further configured to provide decompression for a transducer input representative of a portion of a subband of said sound signal having an instantaneous sound level greater than a decompression threshold, wherein said decompression threshold is greater than said compression threshold; and wherein an asymptotic representation of said transfer function is defined as a cascade of two functions TA1 and TA2, wherein both TA1 and TA2 are defined the general formula:

$$TA=TA(u,A,U,p),$$

wherein for $|u|<U$:

$$TA(u,A,U,p)=Au$$

wherein for $|u|>U$ $$TA(u,A,U,p)=\mathrm{sgn}(u)AU\left|\frac{u}{U}\right|^{p}$$

wherein:

$$TA1=TA1(u,U_c)=TA(u,A(U_c),U_c(Y),p);$$

wherein $U_c(Y)=U_1$ for Y less than $U_1$, $U_c(Y)=Y$ for Y greater than or equal to $U_1$ and less than or equal to $U_2$, and $U_c(Y)=U_2$ for Y greater than $U_2$, wherein $U_1$ represents a quiescent level for said compression threshold, wherein $U_2$ represents said decompression threshold, wherein $U_c$ represents an adjusted compression threshold, wherein Y represents a control signal from said controller for controlling said compression threshold, wherein u represents said transducer input, wherein p represents a compression power, and wherein A represents a magnitude of gain, wherein for Y less than $U_1$:

$$A=G_1$$

and wherein for Y greater than or equal to $U_1$:

$$A=G_1\left|\frac{U_1}{U_c}\right|^{1-p}$$

wherein $G_1$ represents the magnitude of said linear gain; and wherein for TA2=TA2(u)=TA(u,1,$U_2$,$p_2$), wherein u represents TA1, wherein $U_2$ represents said decompression threshold, and wherein $1\leqq p_2\leqq 1/p$.

42. A bandpass non-linearity (BPNL) hearing amplification device adapted to receive and amplify a sound signal, said device comprising:

a memoryless transducer for processing a transducer input according to a transfer function to thereby produce a transducer output, said transducer input being representative of a subband of a sound signal, said transducer output being representative of an amplified sound signal, said transfer function being configured to provide (1) linear gain for a transducer input representative of a portion of a subband of said sound signal having an instantaneous sound level less than a compression threshold, and (2) instantaneous compressive gain for a transducer input representative of a portion of a subband of said sound signal having an instantaneous sound level greater than said compression threshold, wherein said instantaneous compressive gain is less than said linear gain; and a compression threshold controller coupled to said transducer for adjusting said compression threshold at least partially in response to changes in said sound signal;

wherein said transfer function is further configured to provide decompression for a transducer input representative of a portion of a subband of said sound signal having an instantaneous sound level greater than a decompression threshold, wherein said decompression threshold is greater than said compression threshold;

wherein said transfer function is further configured to provide attenuation for a transducer input representative of a portion of a subband of said sound signal having an instantaneous sound level greater than an attenuation threshold, wherein said attenuation threshold is greater than said decompression threshold; and wherein an asymptotic representation of said transfer function is defined as a cascade of three functions TA1, TA2, and TA3, wherein TA1, TA2, and TA3 are each defined the general formula:

$$TA=TA(u,A,U,p),$$

wherein for $|u|<U$:

$$TA(u,A,U,p)=Au$$

wherein for $|u|>U$ $$TA(u,A,U,p)=\mathrm{sgn}(u)AU\left|\frac{u}{U}\right|^{p}$$

wherein:

$$TA1=TA1(u,U_c)=TA(u,A(U_c),U_c(Y),p);$$

wherein $U_c(Y)=U_1$ for Y less than $U_1$, $U_c(Y)=Y$ for Y greater than or equal to $U_1$ and less than or equal to $U_2$, and $U_c(Y)=U_2$ for Y greater than $U_2$, wherein $U_1$ represents a quiescent level for said compression threshold, wherein $U_2$ represents said decompression threshold, wherein $U_c$ represents an adjusted compression threshold, wherein Y represents a control signal from said controller for controlling said compression threshold, wherein u represents said transducer input, wherein p represents a first compression power, and wherein A represents a magnitude of gain, wherein for Y less than $U_1$:

$$A=G_1$$

and wherein for Y greater than or equal to $U_1$:

$$A = G_1\left|\frac{U_1}{U_c}\right|^{1-p}$$

wherein $G_1$ represents the magnitude of said linear gain;

wherein for TA2=TA2(u)=TA(u,1,$U_2$,$p_2$), wherein u represents TA1 or TA3, wherein $U_2$ represents said decompression threshold, and wherein $1 \leqq p_2 \leqq 1/p$; and wherein for TA3=TA3(u)=TA(u,1,$U_3$,$p_3$), u represents TA1 or TA2, wherein $U_3$ represents said attenuation threshold, and wherein $p_3$ represents a second compression power.

43. A bandpass non-linearity (BPNL) hearing amplification device adapted to receive and amplify a sound signal, said device comprising:

a memoryless transducer for processing a transducer input according to a transfer function to thereby produce a transducer output, said transducer input being representative of a subband of a sound signal, said transducer output being representative of an amplified sound signal, said transfer function being configured to provide (1) linear gain for a transducer input representative of a portion of a subband of said sound signal having an instantaneous sound level less than a compression threshold, and (2) instantaneous compressive gain for a transducer input representative of a portion of a subband of said sound signal having an instantaneous sound level greater than said compression threshold, wherein said instantaneous compressive gain is less than said linear gain; and a compression threshold controller coupled to said transducer for adjusting said compression threshold at least partially in response to changes in said sound signal, wherein said controller is configured with:

a first operating mode in which said controller is configured to not adjust said compression threshold; and a second operating mode in which said controller is configured to adjust said compression threshold at least partially in response to changes in said sound signal; and wherein said controller is switchable between said first operating mode and said second operating mode.

44. The device of claim 43 wherein said controller is further configured with:

a third operating mode in which said controller is configured to fix said compression threshold at a current level;

wherein said controller is switchable between said first operating mode, said second operating mode, and said third operating mode.

45. The device of claim 44 wherein said controller is configured to switch between said first operating mode, said second operating mode, and said third operating mode at least partially in response to a user input.

46. A method of diagnosing an extent and form of hearing impairment, said method comprising:

determining an amount of low level gain $G_1$ needed by a patient in a plurality of different audio frequency ranges for sound signals having a low sound level;

selecting a compression power p;

adjusting a hearing amplification device having a plurality of channels corresponding said audio frequency ranges to provide the determined low level gain $G_1$ for each channel and selected compression power p, said hearing amplification device being configured to process an input signal representative of a sound signal according to a merging family of channel transducer characteristics to create an amplified signal, said characteristics defined by (1) linear gain for input signals representative of a sound signal having a sound level less than a compression threshold, (2) rapid compressive gain for input signals representative of a sound signal having a sound level greater than a compression threshold;

presenting a sound signal at an input of the hearing amplification device to generate an amplified signal therefrom;

providing to the patient the amplified signal generated from said presented sound signal; and adjusting the values of said compression threshold for low level gain $G_1$ for each channel and said compression power p until the patient communicates that he/she has perceived satisfactory results.

47. The method of claim 46 wherein said rapid compressive gain is instantaneous compressive gain.

48. A hearing aid device providing instantaneous gain compression for sound signals and adaptive control of nonlinear waveform distortion, the device comprising:

at least one bandpass nonlinearity (BPNL) amplifier comprising a first bandpass filter, a second bandpass filter, and a memoryless nonlinear (MNL) compressive audio amplifier configured to receive a sound signal from the first bandpass filter and provide an MNL compressive audio amplifier output to the second bandpass filter, wherein the MNL compressive audio amplifier is configured to produce the MNL compressive audio amplifier output by providing memoryless gain compression directly on a sound signal that is (1) received from the first bandpass filter and (2) exhibits instantaneous amplitudes greater than a compression threshold, the BPNL amplifier thereby producing a desired gain compression on the received sound signal at an output of the second bandpass filter; and a controller in communication with the at least one BPNL amplifier, the controller being configured to adjust the compression threshold of the MNL compressive audio amplifier.

49. The device of claim 48 wherein the controller is further configured to adjust the compression threshold from a quiescent compression threshold at least partially in response to changes in the received sound signal.

50. The device of claim 49 wherein the controller is further configured to adjust the compression threshold from the quiescent compression threshold at least partially in response to changes in an estimate of a RMS value for the received sound signal.

51. The device of claim 49 wherein the controller is further configured to control waveform distortion caused by the MNL compressive audio amplifier by adjusting the compression threshold from the quiescent compression threshold at least partially in response to changes in the received sound signal.

52. The device of claim 49 wherein the MNL compressive audio amplifier is further configured to provide BPNL gain compression for a tone within its passband via an MNL transducer input/output (I/O) function that is in close approximation to a desired RMS I/O function.

53. The device of claim 52 wherein the transducer function is configured as an odd symmetric function f(u)=−f(−u), wherein u is a sample value of the sound signal processed by the MNL compressive audio amplifier.

54. The device of claim 52 wherein the transducer function is further configured to provide a constant gain for received sound amplitudes below the compression threshold, wherein the compressive gain is less than the constant gain.

55. The device of claim 54 wherein the transducer function is further configured to provide decompression for received sound amplitudes greater than a decompression threshold, the decompression threshold being greater than the compression threshold.

56. The device of claim 54 wherein the controller is further configured to adjust the compression threshold to a value within a range between the quiescent compression threshold and the decompression threshold.

57. The device of claim 56 further comprising a plurality of the BPNL amplifiers, each BPNL amplifier being configured to process a different frequency subband of a broadband sound signal.

58. The device of claim 57 wherein the controller is further configured to adjust the compression threshold for each subband to a value within the range between the quiescent compression threshold and the decompression threshold at least partially in response to an estimate of a short-term RMS amplitude for the broadband sound signal.

59. The device of claim 56 wherein the transducer function is further configured to provide protective attenuation for received sound amplitudes greater than an attenuation threshold, the attenuation threshold being greater than the decompression threshold.

60. The device of claim 49 wherein the controller is further configured to upwardly adjust the compression threshold if the received sound signal exhibits an estimated RMS amplitude greater than a specified amount.

61. The device of claim 60 wherein the controller is further configured to downwardly adjust the compression threshold if the received sound signal exhibits an estimated RMS amplitude below a triggering amount for a duration of time greater than a predetermined release time.

62. The device of claim 61 wherein the triggering amount is derived from a fraction of an estimated RMS amplitude for a most recently received sound signal that caused an upward adjustment of the compression threshold.

63. The device of claim 61 wherein the controller is further configured to maintain the compression threshold and the triggering amount at its current levels if the received sound signal does not maintain an estimated short-term RMS amplitude below the triggering amount throughout the release time duration.

64. The device of claim 48 further comprising a plurality of the BPNL amplifiers, each BPNL amplifier being configured to process a different frequency subband of a broadband sound signal.

65. The device of claim 64 wherein the controller is further configured to coordinate adjustment of the compression thresholds for each BPNL amplifier to produce a desired nonlinear waveform quality.

66. The device of claim 48 wherein the controller is further configured to fix the compression threshold at a current level in response to user input.

67. The device of claim 48 wherein the controller is further configured to adjust the compression threshold between at least (1) a first level associated with a quiet environment and (2) a second level associated with a noisy environment.

68. The device of claim 67 wherein the controller is further configured to adjust the compression threshold between the at least first and second levels at least partially in response to changes in the received sound signal.

69. The device of claim 67 wherein the controller is further configured to adjust the compression threshold between the at least first and second levels at least partially in response to user input.

70. The device of claim 48 wherein the at least one BPNL amplifier is a digital BPNL amplifier.

71. The device of claim 48 wherein the at least one BPNL amplifier is an analog BPNL amplifier.

* * * * *